US007042338B1

(12) United States Patent
Weber

(10) Patent No.: US 7,042,338 B1
(45) Date of Patent: May 9, 2006

(54) ALERTING A CARE-PROVIDER WHEN AN ELDERLY OR INFIRM PERSON IN DISTRESS FAILS TO ACKNOWLEDGE A PERIODICALLY RECURRENT INTERROGATIVE CUE

(75) Inventor: Harold J. Weber, Centerville, MA (US)

(73) Assignee: Savvystuff Property Trust, Centerville, MA (US)

( * ) Notice: Subject to any disclaimer, the term of this patent is extended or adjusted under 35 U.S.C. 154(b) by 125 days.

(21) Appl. No.: 10/726,822

(22) Filed: Dec. 4, 2003

(51) Int. Cl.
*G08B 1/00* (2006.01)

(52) U.S. Cl. ..... 340/309.5; 340/309.16; 340/573.1; 455/404.1; 455/404.2; 379/40

(58) Field of Classification Search ..... 340/309.5, 340/309.16, 573.1; 455/404.1, 404.2, 456.2; 379/40, 45, 46, 51
See application file for complete search history.

(56) References Cited

U.S. PATENT DOCUMENTS 4,492,820 A * 1/1985 Kennard et al. ..... 379/46
4,918,425 A * 4/1990 Greenberg et al. ..... 340/539.3
6,185,410 B1 * 2/2001 Greene ..... 455/100
6,332,100 B1 * 12/2001 Sahai et al. ..... 700/242
6,771,163 B1 * 8/2004 Linnett et al. ..... 340/309.5
2003/0027547 A1 * 2/2003 Wade ..... 455/404
2005/0020274 A1 * 1/2005 Ursini ..... 455/456.1
2005/0032504 A1 * 2/2005 Camp ..... 455/404.2

* cited by examiner

*Primary Examiner*—Jeffery Hofsass
*Assistant Examiner*—Anne V. Lai

(57) ABSTRACT

An emergency hailing device for use by elderly, physically challenged, addicted and medically at-risk users, particularly when living alone. The device periodically interrogates the at-risk user and in absence of a prompt response to the automatic interrogation signal cue, the at-risk user is presumed to need help and an emergency service or prearranged care-provider is automatically beckoned. The device may be worn or set near the at-risk user, available for immediate manual acknowledgment after the interrogation cue signal occurs. Failure to return a prompt response within a presettable time or response absence indicates that a problematic situation may exist and an emergency signal is activated assuring the at-risk user that help will be promptly hailed even if physical or mental incapacitation occurs. Emergency signal may include a bell or siren, a flashing-light to attract neighbors, or a predetermined telephone may be auto-dialed to hail a prearranged care-provider.

20 Claims, 23 Drawing Sheets

ALERTING A CARE-PROVIDER WHEN AN ELDERLY OR INFIRM PERSON IN DISTRESS FAILS TO ACKNOWLEDGE A PERIODICALLY RECURRENT INTERROGATIVE CUE

PROBLEM OVERVIEW

A person living alone is often a potential "victim of circumstance". An injurious fall, heart attack, stroke, food poisoning, seizure, withdrawal symptoms, robbery or bodily attack: all these issues have the potential for threatening the well-being of a single person. Add to this the factors of being elderly, physically challenged, or otherwise limited in response options and the essence of the problem which this invention addresses is immediately evident. Take for example, an elderly person living alone and who has taken a misstep and fallen down, perhaps breaking a limb. Unable to get up from the fallen-down position, the person is in a serious predicament and may be forced to just "lay there" until someone "happens to" show-up and check on them.

Living alone is not the only situation where the condition or physical welfare of a person may be in jeopardy. Even couples and families live at risk from unnoticed situations. For example, a stay-at-home spouse faces all the threatening issues of a single person. Having an accident and it's remaining unnoticed by others for hours, perhaps even days. In a similar way, even an elderly person living with relatives may fall or experience a health threat and remain unnoticed for hours by responsible relatives who may be "out for the day" or even for a few hours.

Medical Considerations

Modern medicine is generally capable of saving human lives, but only if help is obtained in time. For example, the likelihood for a stroke or heart attack victim to attain recovery is good to excellent if they receive prompt attention. Some of the most likely victims of medical crisis who also tend to live alone are stroke survivors, persons with high blood pressure or heart disease, diabetics, epileptics, alcoholics, substance abusers and persons with a variety of other quasi-normal, but potentially life-threatening issues. Consider, for example, that in the United States it is estimated that someone experiences a stroke and becomes a stroke victim every minute.

Often the person with the highest risk problem is also the person who is most likely to stubbornly insist upon "living alone" as an expression of their remaining independence. For example, many aging persons with heart problems frequently live alone, in part due to their sheer numbers and the obscure nature of the affliction. An unattended person who becomes the unwitting victim of any of these ailments and experiences an attack or seizure, may die or become permanently handicapped if reasonably prompt attention is not given. Every day, people living on their own continue to live in fear of having a stroke, heart attack, seizure or simply falling down and breaking a limb or a hip, or any one of a myriad of other failings. The fear is that no-one will know about their circumstance in time for rescue.

Similarly, persons who abuse substances whether it is alcohol or other "recreational substances" (including marijuana, heroin, morphine and other illicit narcotic drugs) and including opium-derived prescription medications often opt to live alone, either because they seek practicing their addiction in private or because their lifestyle has become shockingly repugnant, even to their loved ones. Substance abuse has long been recognized as a precursor to severe brain damage and even death if an overdose or drug interaction is left unattended.

For the most part, these people know that, by living alone they compound the risk of permanent medical damage if they are not attended to quickly in event of a physical or medical mishap. As a result, they weigh the "pros and cons" of the independent lifestyle they aspire to with its attendant risks. For example, substance abusers typically resist a care-provider sponsored environment such as a nursing home, half-way house or rehabilitation center and the result is they often opt to live privately.

It is also well known that senior persons who may have lost their spouse and are therefore single often refuse to be accommodated in a retirement community or group home setting. They may also reject living with relatives. All too often, the independent minded single person, regardless of age or gender, will stubbornly opt for the apparent freedom of an "unsupported" environment often mindful of the substantial chance for "something awful happening".

Crime Victim

Any person living alone is also subject to being preyed upon by con-artists, bully relatives, abusive "significant-others", burglars, perverts and rapists as well as being exposed to a variety of other victimization issues. As a result, the solitary resident of an apartment or house may go "unnoticed as missing" for days unless someone regularly checks on or verifies his or her physical condition. The victim of an assault may often be "saved" if help arrives in time. On the other hand, an injured victim who remains unnoticed for a long period of time may end-up being permanently injured or even die as a result of an assault or physical abuse.

Intervention by Loved-Ones

Living alone is the heartfelt desire of many elderly persons. It is the ultimate expression of their remaining dignity and independence, rather than being "old and helpless". For many, it is the free-spirited feeling of not being at "the mercy of others" which matters. On the other hand, an elderly person ordinarily appreciates having someone unobtrusively "concerned about" or "interested in" their welfare.

Having a bona-fide loved-one or concerned care-provider living nearby is an obvious asset for any person who opts to live alone. A frequent telephone call from a son or daughter, or a concerned sibling, can serve as an informal check-up on their well-being. If the call occurs on a regular basis, the dependent person remains assured that at least they will be periodically (and regularly) checked-up on. Even a brief call suffices, because a non-response to an incoming call originated by a regular caller (such as a son or daughter) may be questionably interpreted as a potential problem by the caller. As a result, the caller (e.g. the son or daughter in this example) may attempt to call again or otherwise check further regarding the dependent person's well being.

On the other hand, a principal shortfall of this sort of telephonic status verification is that it is easy for the caller to merely assume that the called party is "out shopping", at church or involved in some other function which takes them away from the phone. Even an elder equipped with a cellular telephone may be thought to have merely left the phone at home, to have it turned-off or to have let the battery run-down if no answer occurs.

"Call-Later" Rubric Adds Risk

As a result of an uncompleted telephone call, the caller may elect to simply "wait-awhile and call later". While such an assumption by the caller is entirely reasonable, a fact is that during this interval a person truly in distress, such as brought on by a stroke or heart attack for example, could unnecessarily become permanently disabled, or even have expired. As this particular example points out, a real "at risk" time window is ever-present.

Unavoidable Living Alone

Not everyone has the luxury of a nearby relative or concerned person who "keeps tabs" on their well-being. Often grown children live far-away, or sometimes the elderly parent moves far away such as to a quasi-resort type of retirement community. For example, Florida or Arizona may be the residence of the elder, while Chicago or New York might be the children's residence. As a result, daily checks on the senior or otherwise at-risk person's well being is impractical, for a variety of reasons, not the least of which is the sheer cost of regular long-distance toll calls.

Additionally, senior citizens and other care-needy persons are frequently resented when they urge their dependency upon another, particularly a younger or very busy person. Adding to this risk-causing mix is the lot of the dysfunctional family setting in which ordinarily responsible relatives may not even "give a hoot" and therefore ignore the independently living elders care or well-being.

Sometimes the at-risk person simply does not have children or siblings to depend upon, such as a remaining survivor of a childless couple. In this setting, a senior or at-risk person is particularly vulnerable to health related crisis, undetected falls and accidents, being a victim of crime and other similar situations where prompt help and rescue is vital but unlikely to be forthcoming.

Elderly and physically challenged persons often long for someone who would make a regular, periodical check on their well being. If this regular check is not possible, or not practical, even a "robot-like" check on their physical state would suffice if it could be depended upon to work irrespective of the immediate physical condition of the needy person. In other words, they need to be checked-up-on to verify whether they are physically mobile or not and whether they are conscious or not. Additionally, it is useful to be able to be checked-up on as often as necessary, depending upon the physical condition of the needy person. For some situations, once-a-day check-ins may suffice, while for others check-ups once-an-hour may not be often enough.

Senior citizens, handicapped persons (viz., physically challenged persons), recuperating patients and simply persons living alone have numerous beneficial devices available which can afford some extent of emergency alarm support. These prior art systems fall into two general categories:

Central Office and Auto-Dialer Service

Medical alerting systems intended primarily for use by "medically at risk" persons, such as senior citizens and recuperating patients are well known. This type of system is typified by a "Life Alert™" system (Life Alert, Inc. 16027 Ventura Blvd., Encino, Calif. 91346). This type of representative system typically includes a small remote signaling device worn by a client (the user) as a pendant, key bob or bracelet. The usual signaling device includes a "panic" button that, when pressed in an emergency, sends a wireless signal to a nearby receiver which in turn may automatically dial a central office answering facility maintained in support of the system as a subscription service.

Typically, someone at the central office answering facility upon receiving the LifeAlert™ emergency call, answers back through the base unit's loud speaker. Typically, this type of system includes a "listening-in" provision, having a sensitive microphone which can hear verbal calls for help or descriptions of the problem provided by the subscribing-user, or other sounds clueing the nature of the immediate problem. Therefore an audible reply may be listened-for, with a capability for "hearing" the user's reply from a considerable distance. As a result, the central office makes a determination of the probable extent of the problem and typically calls an emergency number or emergency service.

Non-Subscription Alternatives

Variations on this type of LifeAlert™ device includes a variety of non-subscription auto-dialers which simply dial-up any one of several responders or care-providers when an emergency situation occurs. Ordinarily, in this type of private auto-dialer the potential victim wears a pendant sender which includes a button or other physically activated device which initiates a wireless signal picked up by a local base station. The local base station may ordinarily include several preset telephone numbers which may be automatically dialed in order to fetch an emergency response from a care-provider. This type of auto-dialing local system is typified by any one of various devices, including: "Telemergency™ Alert Device" (Model 700, Telemergency Ltd., 200 13th Avenue, Ronkonkoma, N.Y. 11779); "LifeCare™ Emergency Response System" (Model EG-200, Cerebrus Enterprise, Ltd., "Dial-Alert™ Emergency Dialer (Model 433S w/4B-434 Skylink Technologies Inc., 2213 Dunwin Drive, Mississauga, Ontario L5L 1X1, Canada), and "AlertOne™" Safety Products Unlimited, LLC, P.O. Box 1372, Tomball, Tex. 77377) and "Emergency Dialer" (Design Computer Systems, Inc., 1818 North "J" Terrace, Lake Worth, Fla. 33460) which automatically dial one of perhaps several "local telephone numbers" of relatives, friends or other care-providers. A pre-recorded message may serve to alert the called party of a potential problem and sometimes a provision for listening-in and hearing what is going on, or any verbal explanation of the situation, is provided. As a result, the called party may physically check on the user, or call suitable help such as an emergency squad, police or ambulance.

Mobility Sensing

The AlertOne™ emergency dialer further offers the capability for sensing the well being of the user by further providing a "Programmable Mobility Inactivity Timer" the intent for which is to ensure a potential victim's activity by requiring a "check in" at predetermined times if desired. The user must remember to practice a regimen of reporting-in at prescribed times. Unlike the teaching of my immediate invention, the AlertOne™ user is not cued or signaled by a regularly recurrent telltale reminding the user that "it is time" to reply. Without telltale cueing, the user's failure to "check-in" at the predetermined times may occur as a mere natural result of overlooking the "check-in". This may occur as a result of a preoccupation with another matter, simple forgetfulness, or for medical issues such as advancing senility and through usage of certain types of medications may lead to confusion and a false conclusion. Under such circumstances a superfluous "emergency mode" may be erroneously initiated, including the unnecessary dialing of a responder.

Dead-Line Conditions

In prior art systems, an available telephone line is dedpended upon to complete the purported security for the user. However it soon becomes apparent that conditions may occur which prevent the proper line operation, resulting in what is effect a "dead line condition". As a result, no help can be summoned using the "panic button" intrinsic with the operation of the LifeAlert™ or Telemergency™ prior-art when the telephone line is inoperative. As is well know, telephone lines may become inoperative for a variety of reasons including "downed-lines" due to weather, disconnected service for non-payment and sometimes "equipment failure".

Adjunct to Security System

Security alarm systems intended for use by anyone living alone, or by persons who may frequently be left alone or in an unattended situation are readily available. This may include senior citizens, medical risk individuals and generally anyone who wishes to feel "more secure" while at home. "SmartHome.com™" (16542 Millikan St., Irvine, Calif. 92606) is a purveyor of various remote control systems, including "panic button" provision, such as their 4004 keychain remote button that, when used in conjunction with their model 4003 base unit provides a moderate level of emergency protection for a person living alone. For example, if the model 4004 keychain remote is worn as a fob, or pendant placed around the user's neck and utilized as a "panic button", any intrusion by a burglar, falling down (and not being able to get back up) or other problem can be used to activate a local alarm or signal, such as a siren, flashing light or bell to draw attention to a user's at-risk predicament.

Since this arrangement remains deficient in providing non-conditional safeguard for the client/user. The safeguard system equipped with a panic button as a wearable bob lacks the important capability to protect users who simply may not be able to activate the panic button for various reasons. In other words, the SmartHome.com™ system provides no auto-cueing and "reporting-in" provision important to the present teaching. Clearly lacking is any provision for regularly verifying user status, but rather the SmartHome.com™ requires an alert user who has sufficient presence of mind to "press the panic button". Additionally, once the panic button is activated the emergency call must be completed albeit automatically over an available telephone line. As with other systems, a disabled or disconnected telephone line unconditionally blocks this type of hailing resource from being effective in providing immediate aid or assistance.

Deficiency of Prior Art

In each of the known earlier devices the "potential victim" is usually expected to wear a device which he or she may physically activate to signal for help or assistance. The common thread intrinsic with each of these systems is that the intended user must be conscious and sufficiently alert to initiate a "help" signal. As a result, and with the exception of the AlertOne™ system, each of these prior emergency aid signaling devices provide no practical protection for people who live alone and are prone to fainting, stumbling, seizures, or other maladies which may affect their capacity for initiating the "help" signal.

It is fundamental to this invention to find that none of these previously available systems, including the AlertOne™ dialer, are known to regularly interrogate the user's well-being by soliciting a response from the user and further determining that something may be amiss if the user is cued and fails to reply with a timely response. In other words, care-providers who are responsible for a forgetful user or a gerontic user who is partially senile may find that dependable use of a device such as the AlertOne™ unmanageable by the potential victim.

Probably one of the paramount shortfalls of the prior art, such as demonstrated by AlertOne™ is the task of remembering to "report-in" on a regular basis with the result of causing undesirable false alarms. The attendant problem is that the user (or even the user's care-provider) may establish relatively long periods between the reporting-in periods. The undesirable result of this likelihood of a stretched-out reporting period is that, should the user have an emergency event and is left unable to utilize the panic button even minutes after the most recent "report", he or she will remain in difficulty until the time for the next report passes. In practical use, this might be hours.

A further hinderance in the prior art is that even if a regular reporting-in pattern is established, the implication is that the care-provider must be regularly and constantly available at the proscribed call-in intervals in order for the system to be dependable. Given that conditions of an at-risk user may be so fragile that frequent call-in is necessary, the care-provider becomes confined with responsibility that may soon become frustrating if not overwhelming. In short, the care-provider becomes "tied-to" the telephone to accept the regular call-in. Using the present teaching, this becomes a moot point because the at-risk user is regularly interrogated but the care-provider is not hailed unless there is an indication of a likely problem. Furthermore, since the likelihood for the the automated telephone calls for assistance as practiced by my present invention are ordinarily few and far-between, the care-provider is considerably relieved of routine responsibility. Realize also that with few emergency calls being likely, it becomes practical for secondary fee-charging care-providers to be hailed in lieu of the principal care-provider who may usually provide the service for free.

An obvious gap appears between the prior art and this invention in not providing the client-user with a reminder, such as an audible or visible cueing telltale which solicits their prompt response. As a result of the lack of a cue in the existing systems the user might forget to "report in", or is unable to use the panic button. As a result, the care-provider is unable to maintain a near-current assessment of the user's immediate medical or physical state.

This notification lapse is ordinarily due to the care-provider's general inability to promptly detect a user's at-risk situation when the user becomes disoriented or fully immobilized. Such a notification lacking may occur in relatively commonplace situations for needy users including stroke, heart attack, falls, seizures and other disabling events.

Earlier systems unequivocally fail to solicit a response from the at-risk user, such as with an audible or visual cue, which requires a timely response. Instead, they depend upon the at-risk user retaining sufficient presence of mind to "call for help" even if that requires no more than pressing a "panic" button worn on their person. Obviously, this provision may be of little if any assistance to a most needy person, such as someone experiencing a stroke or seizure or whom is knocked unconscious by a fall or similar situation.

No Panic Response Situation

Clearly, when a needy victim (e.g., the at-risk user) becomes incapacitated and most particularly when the victim is rendered unconscious or mentally disoriented by the endangering circumstances, no essential panic response may occur. In otherwords, as taught in most of the prior art, if the victim does not physically press the "panic button", no emergency signal is sent and no care-providers are alerted. Such an at-risk situation may occur for anyone.

In the elderly, situations such as stroke or heart attack may be the root cause. In younger victims, the unconscious state or immobile situation may be the result of a seizure, a debilitating accident (such as falling from a ladder) or serious complications posed by substance abuse or withdrawal symptoms.

A failure to wear the pendant or bracelet as required by the prior art techniques may also deny the victim access to the "panic button". This unexceptional situation may be found to occur under desperate circumstances, such as when having fallen in a bathtub or shower, or while experiencing a stroke or heart attack far from the panic button's pendant device. In short, by merely leaving the pendant device (e.g., "panic button") in the "other" room, a chain of events is set into motion which provides sufficient cause for the prior art concept to fail to protect the user under a most needy situation.

Simply said, if the user can not activate the panic button due to the circumstances of disorientation, seizure, or an unconscious state as well as a situation where the panic button is simply left far from where the need occurs, the panic alert system such as elsewhere described by Life Alert™ (and others, other than the AlertOne™ system, is simply rendered useless.

On the other hand, even the AlertOne™ system requires that the at-risk user periodically press a button at pre-specified times. Without cueing, like this invention provides, the user may simply sleep-through a "report-in" time, causing a false emergency call. The user may also "forget" to report-in at the specified times which may lead to a false emergency alarm.

Characteristically, the more false alarms which occur, the less the likelihood that the at-risk user will be promptly minded by the care-providers. False alarms tend to suppress the "jump up and run over there" protection most at-risk users seek or need.

False Sense of Security

A majority of these earlier systems, in some circumstances, become dangerous and worse-than-useless by their very concept providing a false sense of security which may occur because the care-providers ultimately develop a dependence upon the user having a "panic button" capability. As a result, the absence of a panic alert signal under these circumstances can mitigate the care-providers, user's relatives and other concerned persons into assuming a false sense of well-being, readily believing that "all is well" when clearly the at-risk user's true circumstances may not be, for any one of a manifest variety of incapacitating and otherwise endangering situations.

FIELD OF MY INVENTION

My invention generally pertains to the field of safety and security devices intended for use by elderly, infirm, or physically challenged (viz., handicapped) persons. The field includes providing protection for any persons living alone whatever their age or physical condition. In particular, the invention's field serves to safeguard individuals who experience a combination of living in an isolated environment. This setting may include those who merely reside alone in an apartment or even a single-family house. This lone lifestyle when coupled with the user being elderly is a most frequent cause for concern by relatives and others. One of the most useful applications for the presently taught auto-interrogating monitor may be found applicable in a care-provider's attempt to thwart such a common at-risk situation.

It is commonplace that the user may become a victim of simply living alone and nobody else notices or is aware of anything "having happened" to the user. This auto-interrogator offers an active intervenient signaling scheme which pages the user with a cue on a periodic basis and in absence of a timely response serves to alert a care-provider or other party of a potential likelihood for a problem requiring prompt attention.

BACKGROUND OF INVENTION

One of the objectionable consequences of living alone is realizing that "something awful" including natural death may happen. Hours or even days can pass before anyone else knows. In the most extreme case, a person may simply die. Days or even weeks might pass before others become aware that death has occurred. The media all-to-often reports the finding of a partly decomposed body of someone who lived alone and who was believed to have died "some time ago".

More urgently, a person living alone may experience a life-threatening health problem such as a heart attack, stroke or seizure and the event may go unnoticed for hours or even days, without a care-provider knowing. The result may be death or permanent disability for a person who, if his circumstance had been noticed sooner, may have been saved from death, brain damage or other debilitating conditions. When a person lives alone in an isolated environment, even a lesser impairment, such as having fallen down and broken a leg may go unnoticed and unaided by others.

Calling "911" for Help

In the past, "calling 911" or someone else on the telephone was the most common solution for gaining assistance when something "unexpectedly awful" happened. The shortfall of this approach is that it assumes that the needy party is in condition to in fact make the emergency call. However, such an assumption is invalid if a stroke, seizure or heart attack occurs. Nor may the assumption be valid in the event of a physical mishap, such as when an elderly person falls and breaks a hip-joint. There are countless other injurious situations where a handicap, debilitant injury, or mind altering event may limit or even fully prevent the victim from "calling 911" or a care-provider.

Wireless or "Cell" Phones

A wireless telephone, or a cellular telephone at least permits a user to keep a phone physically with their person. Wireless telephones have become sufficiently small in size and effective in use that they can be readily carried in a pocket, on a belt or even worn about the neck. However, such dependence on having the telephone "with you" still overlooks one of the main problems which may befall an elderly or infirm person living alone. That central issue is manifested in a situation where sudden attack, such as a stroke, a seizure or a sudden fall which knocks the user out may thwart any possibility for hailing help over the telephone, even if it is in reach.

In many life-threatening situations, confusion reigns and the victim is simply not able to make the necessitous call for help. Wireless telephones are relatively complicated and difficult to use (in part due to their usual diminutive size), if you put yourself in the place of the needy user and particularly a handicapped or elderly person. Even cordless telephones are difficult for confused or elderly users. Both cellphones and cordless telephones suffer from battery failure, especially when they are used separate from their "docking station" (recharger) and their regular recharge is overlooked.

A most important point is that, with the largest "at risk" group being the elderly, utter simplicity is desirable because the potential victim is likely to be confused, approaching senility, physically disabled, partially blind, or otherwise limited in their ability to properly respond to a "reporting-in" system such as proposed by AlertOne™. Furthermore the needy user often "forgets" to push the panic button, often due to simple confusion or maybe through sheer anxiety.

An onset of a stroke or heart attack often leaves the user in a panic state, confused and grossly weakened. Heart palpitations and loss of breath can lead to fainting. Eyesight may be affected. Eyeglasses may have fallen away or are not being worn at the time. Trembling fingers may not be controllable. In any event, a strong likelihood prevails that the user may not be able to utilize the perceived benefit of the telephone access just at the time when the situation is grave and the need is definitively the greatest.

Panic-Button Operated Alarm

Known are the earlier mentioned "panic button" actuated alarms which may be configured in form of a bob worn on a necklace, a bracelet or on a key-chain. Pressing the associated panic button ordinarily serves to send a wireless signal to a remote receiver which subsequently sounds an alarm. For example, an outdoor flashing light may be turned "on", or a bell may ring.

A further refinement of this elemental approach includes a remote receiver which auto-dials "911" or a preselected "care-provider" telephone number, alerting the party on the other end that a problem may exist. Potential users often find that many communities simply prohibit or discourage the use of "panic button" callers to "call the police" or "911", due to a propensity for inadvertent false alarms which may place emergency personnel and the public at unnecessary risk in responding to an accidentally initiated "false alarm" call. In some towns, the false dialing of 911 by an autodialer can result in a substantial penalty fine.

Central Station Hailer

Instead of auto-dialing "911" or a local care-provider, the remote receiver may instead auto-dial a central monitoring station. Devices which allow this sort of filtered intervention are known, typified by a "Life Alert™" system (Life Alert Systems, 16027 Ventura Blvd., Encino, Calif. 91436). When a user presses the panic button, the remote receiver auto-dials the Life Alert™ central monitoring office and sets the emergency response system into operation.

In plain language, this means that the central monitoring office makes a formularized determination that an emergency may be underway and that a predesignated emergency service (ambulance, etc.) or care-provider should be dispatched to check further. The principal limitation remains. The potential victim must still remember and be physically able to "press the panic button" to set the emergency response system into action.

Wearing a Panic Button is Not Dependable

A further drawback to a "panic button" actuated situation alarm is that the panic-button "sender" device must be worn at all times to be readily available to a user when it may be most needed. A panic button "left in another room", on a bedside stand or in the dresser drawer across the room is often as bad as not having one! Panic buttons may also be lost. Sometimes, the signal sent by the panic button is not strong enough to be satisfactorily received by a remote. For example, a user who decides to work "out back in the garden" may inadvertently be out of range of the remote receiver and yet it is precisely this sort of exceptional situation (e.g., stressful working in the heat while in the garden, etc.) that may lead to the need for the panic button due to heart attack, stroke or even a fall-down injury.

It is well known that the range of most "panic button" actuated senders is similar to "cordless telephones" (e.g., not cellphones), with a dependable limit of less than about 150 feet, depending upon where the receiver is sited in the user's premises.

Panic Button Must be Pressed

A most significant limitation of the panic button approach is that the panic button must, in fact, "be intentionally and manually operated". In other words, the panic button has to be deliberately "pressed" by the distressed user.

In many emergency situations, the victim may become confounded, unconscious or otherwise unable to fulfill this seemingly simple essential manual step of "pressing" the panic button. For example, a person experiencing a stroke, heart attack, seriously palpitating heart or seizure may simply not "immediately remember" to press the panic button to hail for help. All too often, the victim may further choose to initially wait to see if the affliction will "go away". Sometimes the victim simply has too much pride to "bother others" with his or her first signs of an attack.

As a result of the waiting, the condition may quickly worsen to a level where the victim can not, forgets or otherwise fails to press the panic button. Strokes and various kinds of diabetic, epileptic and substance abuse (or alcoholic) seizures are known to result in this potentially fatal lack of capacity for even rudimentary action, e.g., merely "pressing the panic button". As a result, no hailing alarm is initiated signifying a responder of a user's difficulty. Consequentially, the user or victim may die or suffer irreparable brain damage before "help" otherwise avails itself, in absence of the user having initiated the emergency signal.

SUMMARY

My invention overcomes the multitudinous shortfalls of earlier passive-device based methods for establishing an assured well-being of a client user. I utilize a periodically recurrent interrogative cuing signal which must be responded to by the subject user or potential victim to assure a remote care-provider that the user is apparently okay. Furthermore, the cue signal must be responded-to within a finite period of time elsewise a presumption may automatically occur that "something is amiss". For example, a client-user may be an elderly person; a physically-challenged person; an infirm person suffering from any of various debilitating disabilities or frailties; a person prone to substance abuse; or a person subject to seizures or medical attacks. The client-user may also suffer from relatively common disease-issues such as Alzheimer's disease, common dementia, variations of Down's Syndrome or other conditions which may lead to confusion and thereby benefit from monitoring by a care-provider.

The safe call intended by my invention's practice may also assist persons having a drug dependence, or who suffer from bouts of various types of mental disability. Most particularly it is intended for persons who reside alone, or who spend a substantial amount of time removed from other concerned persons or care-providers.

You Ok? I'm Ok! Checkpoint Procedure

By using the periodic interrogation approach, my invention affirms that the user is "probably okay" when an interrogation signal is replied to within a preestablished interval of time after it's occurrence. On the other hand, a lack of a timely acknowledgment, within certain predetermined limits (or conditions), may be construed as being reasonably indicative that "something might be wrong." Loosely translated, my invention embodies a classic checkpoint interrogative "You Okay?" query answered by an assuring "I'm Okay!" response.

One of the aspects of my invention is to set the filtering criteria for establishing boundaries for defining a likelihood or probability of a problem having actually occurred, as opposed to a normal course of events. More importantly, the parameters of this filtering criteria may be conditionally tailored to conform with the lifestyle characteristics and issues of the person being monitored, e.g. the "client" user. Key filtering criteria include time between interrogations and how quickly a response is made by the user subsequent to interrogation. These key factors may be further expanded upon, as delineated throughout this teaching.

Check-In Routine Procedure

An underlying feature for my invention is to afford the client with a regularly recurring check-in routine. In a most basic form this may take the form of the client "resetting" a periodically "armed" or automatically "set" switch one or more times every day on a predefined schedule. For a person merely living alone, but with no medical issues or other threatening factors, a "once a day" verification may be sufficient. On the other hand, persons having more medical issues, who are elderly or who live in a dangerous environment may benefit from more frequent verification.

Arming as a Function of Time

My invention may be embodied to be armed or "set" on a periodic time-of-day basis. It may also be armed in accord with a weekly schedule, e.g. more often on some days than others. This profiling fits the person who lives alone, but holds a job. Typically, system setting or arming is only needed when the person is "at home". Automatically arming of the system when the user is at work or otherwise covered is not needed and hence undesirable.

Arming means that the system is operative, tending the safety of the user. When the system is not armed, the user is not interrogated and a risk condition may go unnoticed by others.

In an elemental way, this resetting of the switch in accord with the setup or arming schedule indicates that the client is at least well-enough, physically and mentally, to actuate the switch on the prescribed routine schedule. In an exampled embodiment, this verification routine may be further filtered by requiring that the "switch" be reset within a predefined period of time after the switch is "armed" or set. In other words, if the switch is reset (for example) by the user within an hour after having been armed, the client user is probably ok. Conversely, if more than an hour passes, there may be a problem or the user may have simply forgotten to respond.

Further response filtering may be provided to overcome the possibility of an entry of a reflexive response submitted by an even partially unconscious or otherwise disabled victim. For example, two response keybuttons may be provided spaced sufficiently apart that one finger can not activate both of them. If one button is called "A" and the other "B", a satisfactory response by an "okay" user may be denoted by first pressing "A" and then pressing "B" as separate actions. This sort of rudimentary filtering serves to set-aside a likelihood for a false reflexive response occurrence.

The indication of a problem having occurred may be locally handled by sounding a reminder alarm, such as a buzzer or bell or even a light when the reset period has elapsed. This local reminder alarm should be sufficient to "remind" the client to immediately reset the switch, if it was simply forgotten. On the other hand, if the switch is not timely reset after the local reminder alarm goes-off, a presumption may reasonably be made that a significant problem may have occurred. As a result, an emergency number may be dialed (such as "911"; a care-provider's number; or a central monitoring station).

Public Alarm Cry for Help

Similarly, a local public alarm may be given in the form of a bell, horn or flashing light beacon to alert a neighbor or passerby of a possible problem. In many regards, the local public alarm may work more effectively than others since drawing the attention of a neighbor may be quicker than auto-dialing a care-provider who may have momentarily stepped away from their phone or otherwise be delayed in responding.

Worn Device Prompts User

This preceding approach for my invention is described as a freestanding device. A further improvement on the free-standing apparatus approach is to have the client wear the invention's interrogator device configured as a bob supported on a chain hung about the client's neck, worn as a wrist bracelet, or simply clipped onto the client's clothing. In this arrangement, the timing function and acknowledgment (reset) switch is (switches are) fashioned as a key part of the bob or bracelet worn by the client.

My device configuration most commonly cues the wearer by emitting a "beep" from the bob or bracelet on a regular schedule and the wearer (client) acknowledges the signal by pressing a reset button or exercising an equivalent action. Additionally, a light emitting diode may blink thereby cueing the wearer and indicating that the "arm signal" has been "set". The indicator light is particularly useful as a cueing signal for a hard-of-hearing user, or in a noisy environment such as even while watching television or listening to the radio and particularly in a public setting, such as at a meeting, in church, at the movies and similar situations. If the acknowledgment is not timely given after the cue (alert), the circuits associated with the bob or bracelet device send a wireless signal to a nearby receiver which recognitively processes the signal and determines an alarm action.

Presumption of User's State

Normally if a user initiated response to an alert beep or lamp blink is promptly forthcoming, before a time-out of the grace period after the alerting cue occurs, the client is presumed to be in a satisfactory condition. If the acknowledging response is late or missing altogether, the receiver establishes an alarm state.

The alarm may consist of merely a local signal such as a bell, buzzer or flashing light mostly intended to alert a passerby or neighbor that a problem may exist. More generally, the receiver may also be embodied to connect with the telephone line and proceed to automatically dial "911", a predetermined care-provider's number or a central monitoring station.

Dynamic Filtering of User Response

I have found it to be beneficial from a safety point of view to narrow the criteria for user response when the user is found to slacken-off in responding. In other words, the longer the delay before the user submits a reply by "pressing the button" after an interrogative signal is developed, the more frequent the interrogative signals become. This tightening of the cue response criteria offsets a situation where the user, or potential victim of a crisis state, becomes increasingly more dazed or groggy as a result of an impending situation (e.g., a seizure, stroke, etc.) requiring the services afforded by my emergency hailing system.

What my system advantageously teaches is a capability to quicken the rate of interrogative signal repetition (e.g., shorten the time between interrogations) as the user's reaction time to press the button after the interrogation signal trends an increase. Additionally, my invention may decrease the response time window between when the interrogation signal occurs and when the user must reply as a result of the user "slowing down" in response timeliness. In effect, the slower or more sluggish the user's responses become, the more likely the user is to set-off the emergency hailing system signaling mode.

Reducing False Alarms

An embellished form of my invention's wearable bob may proceed to give the wearing client a "beep" which should be acknowledged within (as a mere example) about one minute. If the hailer's cue is not acknowledged by the wearer, the bob may emit a succession of several "beeps", repeating as necessary if no response is made by the client.

After a short while (e.g., another minute more or less), the bob's logic may make a determination that "yes a problem probably exists", since the wearer is not responding to the bob's signal beeps. This logical determination intends to establish the potential for a crisis situation as likely to be real and not false simply due to an overlooked response by the bob or bracelet wearer.

The next step, if still no acknowledgment is made by the client, is that the bob sends a wireless signal to the remote receiver and the receiver takes the necessary steps to hail or signal a care-provider. This may include dialing "911" or some other telephone number, such as the care-provider's, a neighbor, a friend or a nearby relative, or a central monitoring station. This dialing action may be delayed for a finite period of time, during which a alarm such as a buzzer or a flashing light is activated to locally hail help from nearby persons. The local alarm may also be embodied to initially set up a raucous indoor signal to "wake up" the user to respond to the "arm" signal and if no user response is soon forthcoming, outside local alarms may be subsequently set off to hail neighbors, passers-by or other parties.

The interrogative bob or bracelet is particularly convenient for the person who comes and goes a lot. It overcomes the problem of forgetting to turn-off (pause) the local alarm receiver, when the interrogatory signal is developed at the receiver. A worn bob or bracelet may be reset where-ever the user is, even if away from home.

Cell Phone Emergency Hail

When a user of my invention is "on the go", a heart attack, stroke or other emergency condition may go undetected even when the bracelet or bob is being worn and the arm (set) signal is not promptly reset. This results when the user is out of range from the base station, or local receiver. For example, the user may be in the shopping mall parking lot when an attack occurs, while the receiver is "at home".

My invention includes a provision whereby a compact terminal receiver worn by the user (similar in configuration to a small radio such as a Sony Walkman™) may respond to an emergency signal determined by the failure to respond to a cue from the wearable bob. The terminal receiver may, in turn, link to a cell phone carried by the user. Alternatively, elements central to the compact terminal receiver may be included in the cell phone construction, essentially combining the terminal receiver and the cellular telephone into a "one piece device" for unfettered simplicity of utility by the client-user.

The a cell phone signal may be automatically sent as a "cry for help" to a care-provider or other supportive party. This autocalling approach works particularly well when the care-provider is provided with an advance agenda or schedule for the user's likely activities. Even better service is assured whenever the telephone industry includes cellphone tracking capability to pinpoint the origin of an emergency call.

When my invention includes the cellphone autocall feature, I further show that at least a basic GPS (ground positioning system) receiver may be activated in response to the emergency signal and provide approximate location coordinates for the endangered victim through the cellphone connection.

Panic Hailing Device

For wearer's who do not have, are out of range from or can not afford cell-phone service a similar terminal receiver, configured as a small "belt worn" device may be triggered by the bob's emergency signal. The portable terminal receiver operates in a manner similar to a base station receiver in that it processes the emergency signal into a "hailing" signal. In this version of my invention's teaching, however, the terminal receiver is primarily oriented towards producing a raucous, attention getting sound or light which can alert other nearby persons of the likelihood that a crisis situation may have occurred. The bottom line is simply that it is more beneficial for a user to draw public attention to his or her plight in an emergency such as a heart attack, than to merely "lay there and die" or become paralyzed.

Auto-Paging Interrogator

For monitoring subject who are frequently "on the go", another form of the auto-interrogator panic alarm may be embodied. This is particularly suitable for the younger person who may be at risk due to potential heart attack issues, seizure likelihood, substance abuse issues and other considerations. In this form, the invention is embodied as a "two way" pager. A central monitoring station may communally page each of a number of dedicated "portable pagers" on a regular basis. Some may be paged (e.g., interrogated) more frequently than others, in accord with a "need-for-concern" schedule, or other plan.

The central page transmitter sends out a regular interrogative signal to each remote pager. This interrogative signal is encoded to be uniquely received by one or more of the receiving pagers, where it "sets off" a local telltale signal. The telltale may utilize any of the common schemes, including a telltale beep, blinking light, buzz, or vibratory action.

Upon sensing the interrogation telltale, the user promptly acknowledges its occurrence by pressing a "reply" button. This sends an encoded return signal to the central monitoring exchange which is recognized as an "all is okay" signal. Failure to reply with the encoded return signal will, on the other hand establish that something may be wrong. Ordinarily, one or more additional pages may be attempted and if still no reply is returned, the result may be the dispatch of assistance.

Location of a pager equipped victim may also include satellite positioning techniques, similar to the GPS provision mentioned relative with the usage of cellular telephone systems. As a result, help may be more efficiently and quickly directed to the immediate locale of the user.

Verifying Care-Provider's Attention

Auto-dialed telephone numbers for emergency situations lack assurance that the auto-dialed party actually "receives" the crisis message. In other words, the auto-dialed telephone may answer automatically and receive the message as a voice-mail recording. The result is that the at risk client's emergency call may go unnoticed. Usually, auto-dialers are set up to sequentially call any one of several numbers of persons (or services) who may "take care of the problem". Auto-dialers are known which try another number if the first number does not answer. Other auto-dialers are known which identify answering machines and proceed to dial the next number. In my invention, I include a peripheral feature where it is necessary that the auto-dialed called party press a predetermined TouchTone™ dialing keypad button to acknowledge receipt of the incoming emergency call. In absence of this acknowledgment by the care-provider, the auto-dialer proceeds to the next predesignated care-provider party. As a final resort, and if no predesignated care-provider (such as a relative, friend or neighbor) acknowledges being receptive of the emergency signal, the auto-dialer may as a final resort, proceed to dial a rescue squad or "911" for assistance.

OBJECTIVES

A primal objective of my invention is to interrogate an "at risk" user on a regular, periodic basis to verify that the user is apparently okay.

A fundamental methodology underlying my invention is to implement a "you okay, I'm okay" approach where the user is automatically and regularly queried and must acknowledge the query within a brief interval and otherwise if user remains non-respondent, a care-provider is automatically notified of the lacking response and an occurrence of a possible problem.

A essential point of my invention is to utilize a "cue and reply" method to accomplish the "you okay, I'm okay" approach, where the user of the device is summarily cued by a beep or light blink and then allowed a short period of time to responsively acknowledge the cue, asserting thereby that "all is okay".

A main point for my invention is to assure a user who is living alone, or who spends a substantial amount of time alone, that a care-provider will respond to the user's emergency predicament whether caused by a medical issue, being elderly, an ordinary accident or being victim of a crime.

A key purpose for my invention is to objectively signal for "help" if a user does not respond to the interrogation within the limits of predetermined response filtering conditions, such as time and regularity.

The spirit of my invention is to assure a solitary user that in event of an emergency situation where he or she can not call for help, their predicament will be noticed and an alarm will occur or help will be dispatched.

A further goal is to provide for the use of a worn device such as a necklace borne bob or bracelet which may be used to respond to system interrogation and thereby indicate that the user's physical well being and mental state are within predetermined bounds.

It is an important intent to provide the ability to establish the well-being of person living alone who is challenged with health issues.

The essence of my invention is to assure a user living alone that a care-provider will be notified in event of an incapacitating situation.

It is a further intent to provide a device which requires prompt responsion by a wearer of the device to assure the care-provider system that the user is in fact relatively okay and not a victim of a medical or physical predicament.

Additionally, my invention intends that a user may pre-establish that various combinations of alternate care-providers may be summoned by providing for the auto-dialing of any one of several different care-provider under different immediate circumstances, such as time of day.

My invention also proposes that a portable interrogation of a user who is "on the move" and away from a local (or home sited) base-unit may instead be periodically interrogated by and submit a timely reply to a central monitoring exchange, through a pager-like device.

A key capability for utilizing my invention affords the user of the auto-interrogator to couple the device interactively with a cellular telephone apparatus to accomplish calling a care-provider in event of a user's failure to submit a satisfactorily and timely response to an interrogation telltale.

To consider the bottom line for my invention, an at-risk user is automatically interrogated by a cue and expected to physically enter a timely response acknowledging the interrogation and to automatically call a designated care-provider in event the timely response is lacking.

It is these and other key factors which define the substance of my invention's goals, the spirit for which is to provide a user with essential safeguards in event of a disabling situation which assure that help and assistance will materialize within a reasonable period of time.

DESCRIPTION OF DRAWINGS

My invention is depicted by 23 sheets of drawings showing 24 figures, including.

DESCRIPTION OF INVENTION

Figure 1:
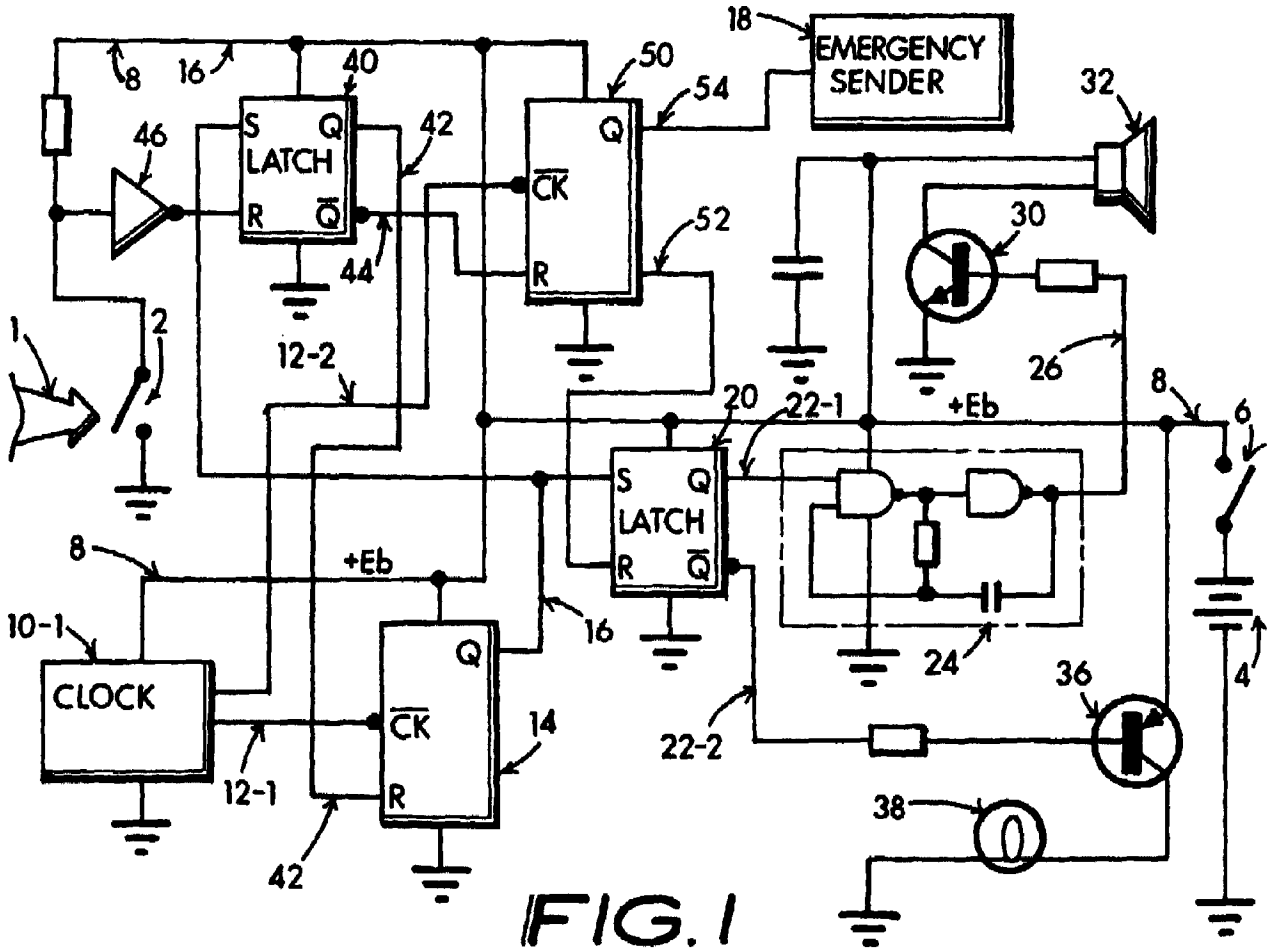
FIG. 1—Block diagram for a cuing interrogator issuing a "beep" tone or light "blink" which must be acknowledged by promptly pressing a switch or else an emergency signal is sent.

A remote emergency hailer conforming to the spirit and claimed essence of the underlying art of the invention may be physically embodied in numerous arrangements, particularly in view of ever-present advances in the state of contemporary technology. My FIG. 1 shows a representative arrangement where an operator may manually actuate 1 closure of a switch 2 in timely reply to being cued. In this hookup, a clock 10-1 delivers a clocking signal on line 12-1 that couples with the /CK input of counter 14. The counter may be a conventional CMOS device, typified by the CD-4020, CD-4024 and CD-4040 family of integrated circuit binary counters.

This counting function, and other discrete functions herewith described, may obviously be more contemporaneously realized by a utilizing a virtual function provided by a software instructed microprocessor circuit configuration.

In my depicted arrangement, a combination of the clock frequency delivered on line 12-1 and the number of counter stages intrinsic to the counter 14 determines the time elapse before Qn line 16 goes HIGH, thereby SETing the latch 20 and the latch 40. The result is a HIGH state on the latch 20 output Q line 22-1 and the latch 40 output Q line 42. The line 42 loops back to the RESET input of counter 14, resetting and maintaining the counter 14 outputs in an all-LOW state. Concurrently, the /Q output line 44 level of the latch 40 drives LOW as coupled with the RESET input of the binary counter 50, thereby enabling it to advance-count in accord with the clocking signal delivered on line 12-2. This in effect creates the "window of response expectancy" (WRE) during which the user must respond by actuating the switch 2 to avert an emergency signal from being determined on line 54.

States of Response

If the user promptly responds to cuing, during the active WRE period and prior to the counter 50 advancing through its count range, the output on line 54 remains LOW. For example, if the clock frequency "$F_{ck}$" is 3.75 hertz (60 hz/16) on line 12-2 and the counter 50 has twelve stages "Q'", the elapsed time "$T^e$" in minutes is represented by:

$$(Q(n-1)/Fck)/60=Te, \text{ or}$$

$$(2(12-1)/3.75\ Hz)/60=9.1 \text{ min}$$

e.g., 9.1 minutes of time elapse during this example period. Momentarily closing the switch 2 draws the input of the inverter 46 LOW driving the output HIGH as coupled with the RESET input of the latch 40. Hence line 44 drives HIGH as coupled with the RESET input of counter 50 and the counter is inhibited from advancing states and all the output lines are set and maintained in LOW state.

Failure to perform a timely closing the switch 2 during the WRE and prior to the counter 50 fully advancing, results in the signal on line 54 being driven HIGH. The failure, or belated response in closing switch 2 may be reasonably be indicative of an inability on the part of the user to respond to the cue in the timely manner. As a result, a level-shift on line 54 represents the "emergency" signal as coupled with the emergency sender 18.

Cuing the User

When the latch 20 is SET the Q line 22-1 drive HIGH as coupled to the input of a NAND gate element comprising a portion of an astable multivibrator 24. The timing elements of the multivibrator are selected to deliver an audio tone signal on line 26 that couples with the base of a NPN transistor 30. The transistor drives an audio sounder 32, emitting a telltale cuing note to the user. The duration of this "beep" or brief tone is determined by the signal state on line 52. The tone signal generates when the state is LOW and stops when the state on line 52 drives HIGH (for the first time) as determined by one of the lower state counter outputs from the counter 52. In effect a "beep" may occur, since after the line 52 rises HIGH, the latch 20 resets and the multivibrator 24 is functionally inhibited. Timing is such that the telltale "beep" preferably occurs at the onset of the WRE period.

A visual telltale may also occur when the /Q output from the latch 20 is driven LOW on line 22-2 as coupled with the base terminal of a PNP transistor 36. The immediate result is current flow through the collector circuit as coupled with the lamp 38 thereby "lighting the lamp" and providing the user with a visual cue. The visual cue is preferably maintained for the duration of the WRE period.

A battery 4 or similar power source (such as a "power pack" or "ac adapter") provides essential DC power through a switch 6 that couples with the +Eb power bus 8 to provide necessitous operating power for circuits attendant with my device.

Figure 2:
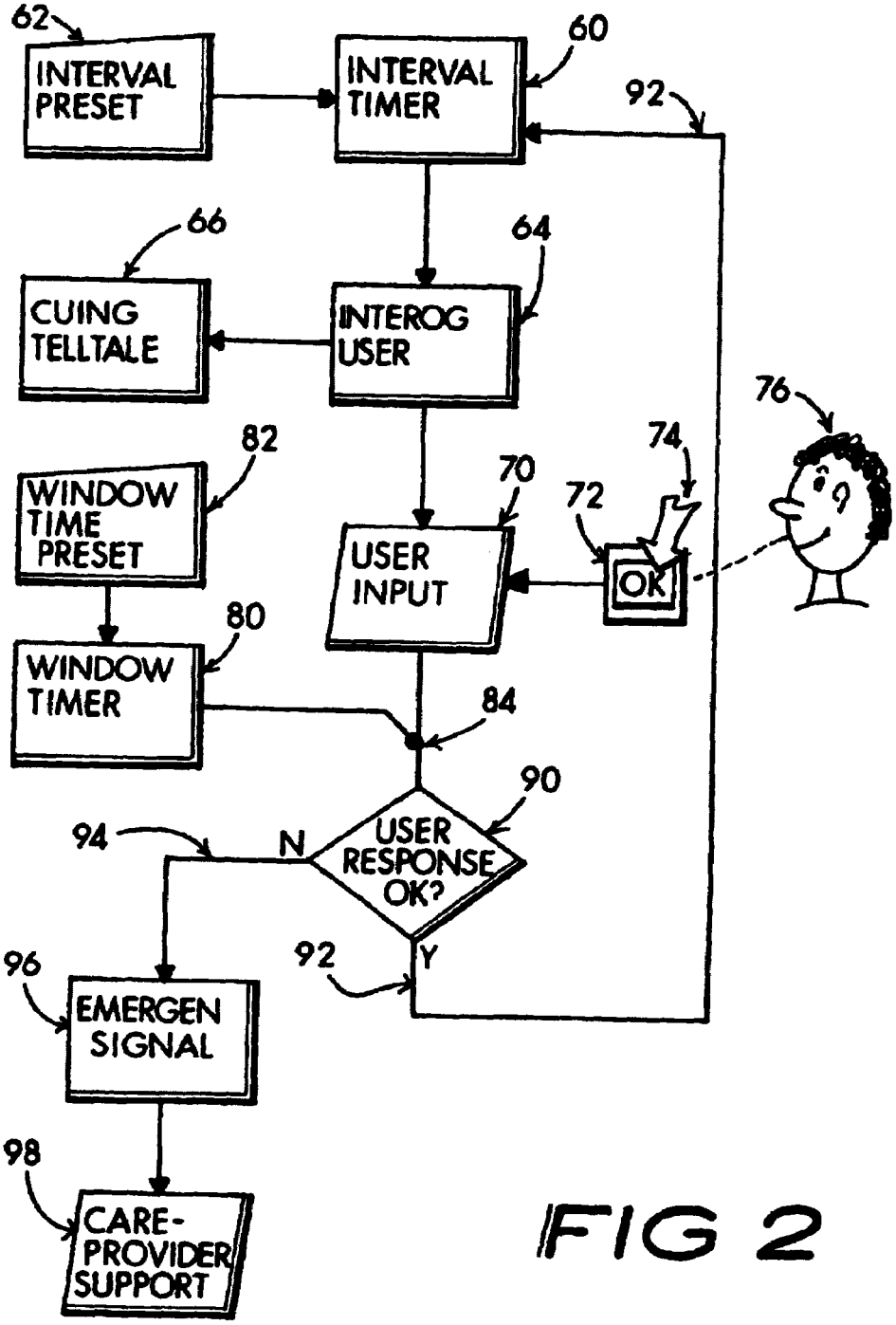
FIG. 2—Flow diagram for an interrogator showing relationship of timers, cuing and response states while a failure to quickly respond to a cue results in an emergency signal that may dial-up a care-provider.

A logical flow diagram appears in FIG. 2 showing the various events related to an interrogatory hailer, such as described relative with FIG. 1. An interval timer 60 is preset by the user to specify how often the client/user will be cued for affirmation. In other words, the interval preset 62 may be set to cue the user every hour, once a day or even every 5 minutes as deemed appropriate in view of the extent of risk the user represents.

The interval timer 60 sends an interrogation signal to an "interrogate-user" function 64, which in part couples with a cuing telltale 66. The cue may be an attention getting audible "beep", a light or even a vibrator such as commonly utilized with ordinary "pagers". The "interrogate-user" function 64 also couples with a "user input" function 70 that includes a switch provision 72 that may be manually actuated (pressed) 74 by the at-risk user 76.

A "window timer" 80 establishing the WRE period is preset 82 with a preferred time duration suitable for accepting a post-cue response from the user 76. For example, this time might be 1 minute, 5 minutes and even half an hour, again depending on the extent of at-risk exposure the client/user represents. In any event, the timer 80 duration for WRE is ordinarily a small percentage of a cuing repeat interval established by timer 60.

The window timer 80 output and user input 70 are conjunctively coupled with a "User Response OK?" decision function 90. In event the user 76 responds suitably within the WRE time aperture allowed by the window timer 80, a "YES" decision is found on line 92 which loops back to the interval timer 60, resetting it for an onset of the next interrogation period.

Conversely, if the user 76 fails to respond during the time window (WRE) established by the window timer 80, a "NO" decision is found on line 94 that initiates an "emergency signal" function 96. The resulting emergency signal may couple with an auto-dialer 98 and dial a care-provider for support.

Figure 3:
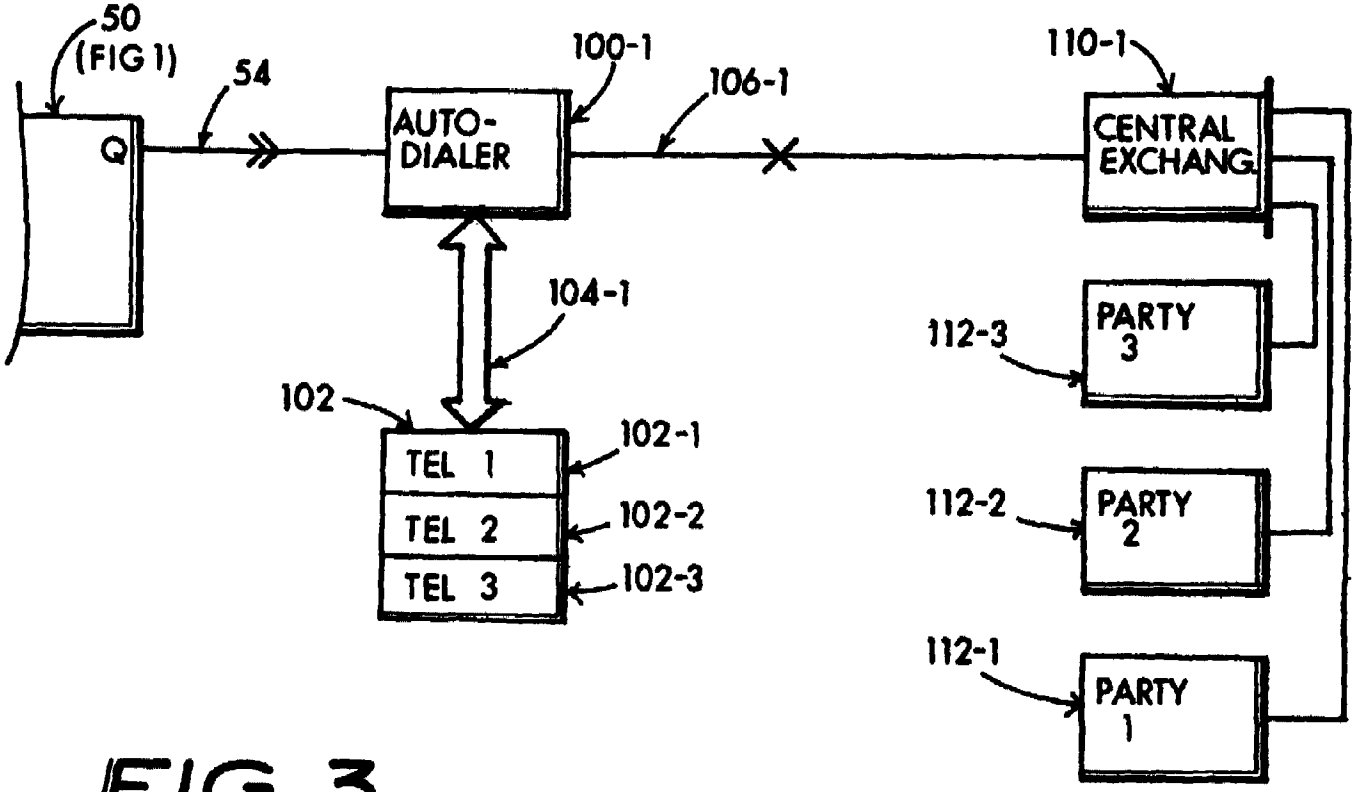
FIG. 3—Blocked out diagrammatic detail of an autodialer that may dial any one of several care-providers as coupled through a central exchange.

Continuing with FIG. 3 I show the counter 50 output line (derived from FIG. 1) extensive 54 to an autodialer 100. As is well known, an autodialer is a device which automatically dials any one of a number of stored telephone numbers held in a registry preset by the user.

For this example of FIG. 3, I show the autodialer 100 coupled 104 with a registry stack of three different care-provider telephone numbers 102-1, 102-2, 102-3. In response to an emergency signal presence on line 54, the preset dialing number is used to autodial and deliver the stored message over line 106 to a telephone service provider's central exchange 110-1. It is then dispatched to any one of several "called parties" 112-1, 112-2 or 112-3 usually in an order of a preferred priority. In other words, if the first does not answer, the next one is attempted. In the conventional practice of this invention, the called parties ordinarily are care-providers. Different times of a day (or week, etc.) may require different combinations of on-call care-providers. I therefore in FIG. 4 I show a "clock controlled" time-dependent selection of emergency call telephone numbers, stored in different combinations. In other words, different care-providers may be automatically called at any one of several predesignated times of the day. The counter 50 of FIG. 1 couples 54 with an autodialer 100-2 in a manner functionally similar to the description of FIG. 3. The output of the autodialer 106-2 subsequently couples with the usually public telephone service's central exchange 110-2. As previously mentioned in conjunction with FIG. 3, the central exchange 110-2 directs the incoming connection 106-2 with any one of many parties 112-1, 112-2, 112-3, 112-4, 112-5 who may be care-providers or emergency medical technicians, etc. The operation of the central exchange 110-1 of FIG. 3 and 110-2 of FIG. 4 is merely depicted for understanding the overall invention's operation and how the different elements relate with one-another.

Figure 4:
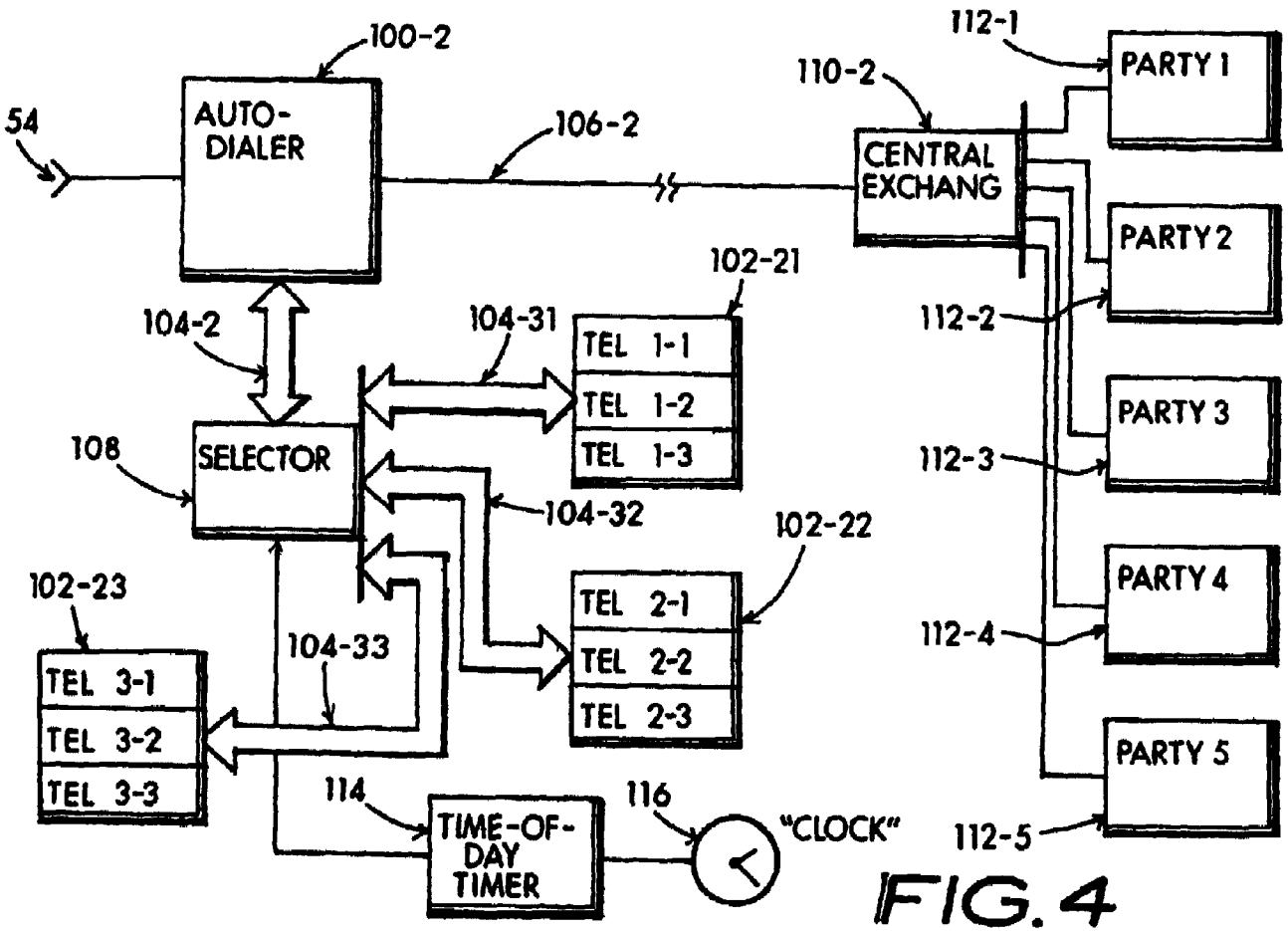
FIG. 4—Extension of FIG. 3 for autodialer to call different combinations of care-providers, for example, at different times of day.

In FIG. 4 I show a clock 116 which, in conjunction with a presettable "time of day" timer 114 may define the immediate selection of different combinations of on-call care-provider numbers. This is attained with the output of the timer 114 coupled with a selector 108 that may pick any one of several inputs 104-31, 104-32, 104-33 each of which connect with different stacks of pre-stored telephone numbers 102-21, 102-22, 102-23. What occurs is that the timer 114 (by way of representative example) may enable the selection 108 of stack 102-21 between 8:00 AM and 5:00 PM. Stack 102-22 may be timely selected between 5:00 PM and midnight, for example. Additionally, Stack 102-23 may be the callable numbers reserved for the late night shift between midnight and 8:00 AM. As a result, the most effective protection coverage may be provided without imposing unnecessary burden on any one of the care-providers during their "time-off".

Figure 5:
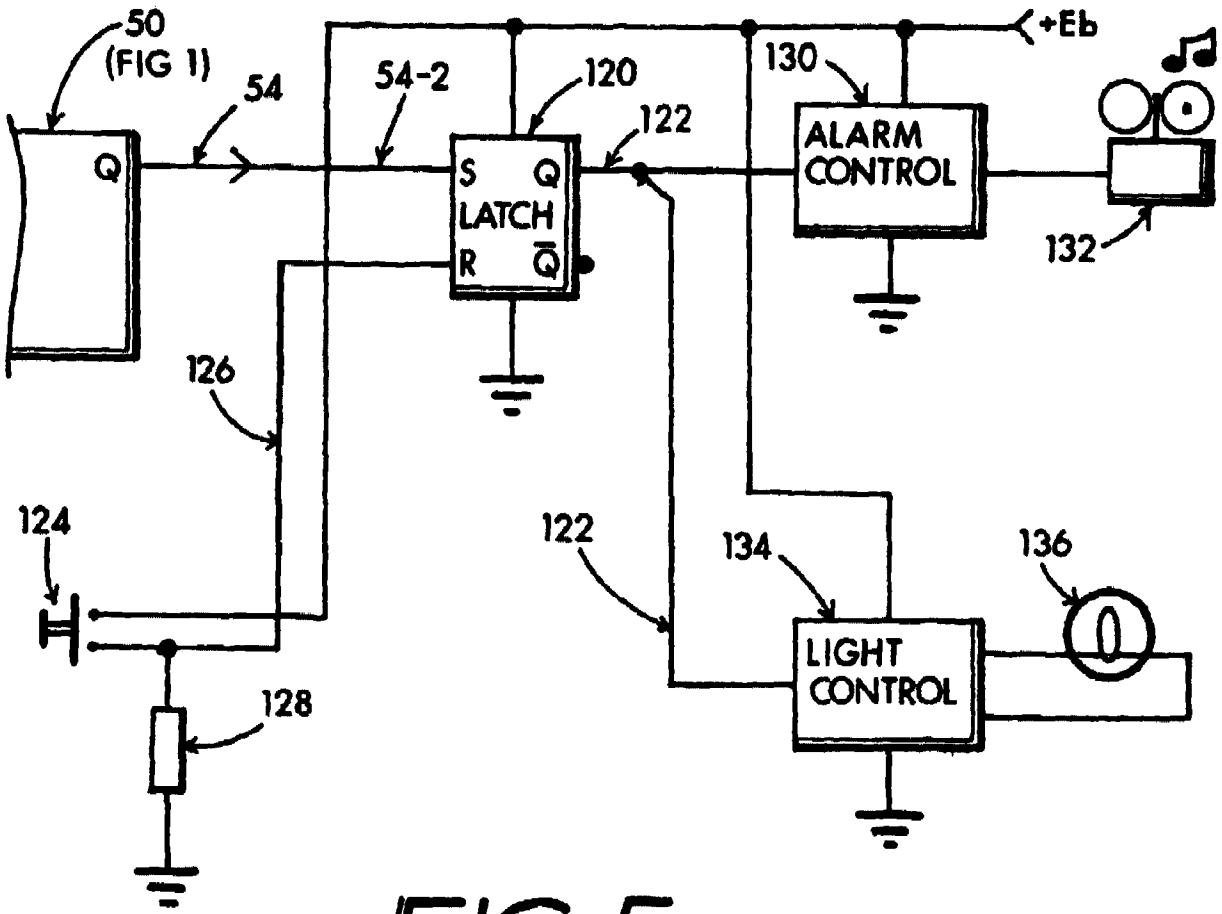
FIG. 5—Functional diagram for extension of FIG. 1 emergency sender 18 including a switch to discontinue emergence warning signals once initiated by a failure to promptly respond to a cue.

My next showing with FIG. 5 is the counter 50 output line (derived from FIG. 1) extensive 54 to a SET input of a latch 120. When an emergency signal HIGH state appears on line 54 the latch "sets" with the Q output line 122 driven HIGH. This line 122 couples with an alarm control circuit 130 producing an output which may stimulate a bell 132, or other local emergency warning device such as a siren, horn, buzzer and the like.

The line 122 may also couple with a light control circuit 134 which "turns-ON" a signal light 136 usually arranged to be visible to others. The signal light may also include an emergency beacon or similar device which serves to hail a passerby or neighbor of an emergency situation. I also include a RESET or shut-off provision including a manually actuatable switch 124 coupled with the RESET input line 126 for the latch 120. Normally the line 126 is held LOW by virtue of a pull-down resistor 128 (typically about 1,000 ohms more or less). Closing the switch 124 contacts pulls the line 126 "up" to a HIGH state, e.g. to +Eb which resets the latch 120.

Figure 6:
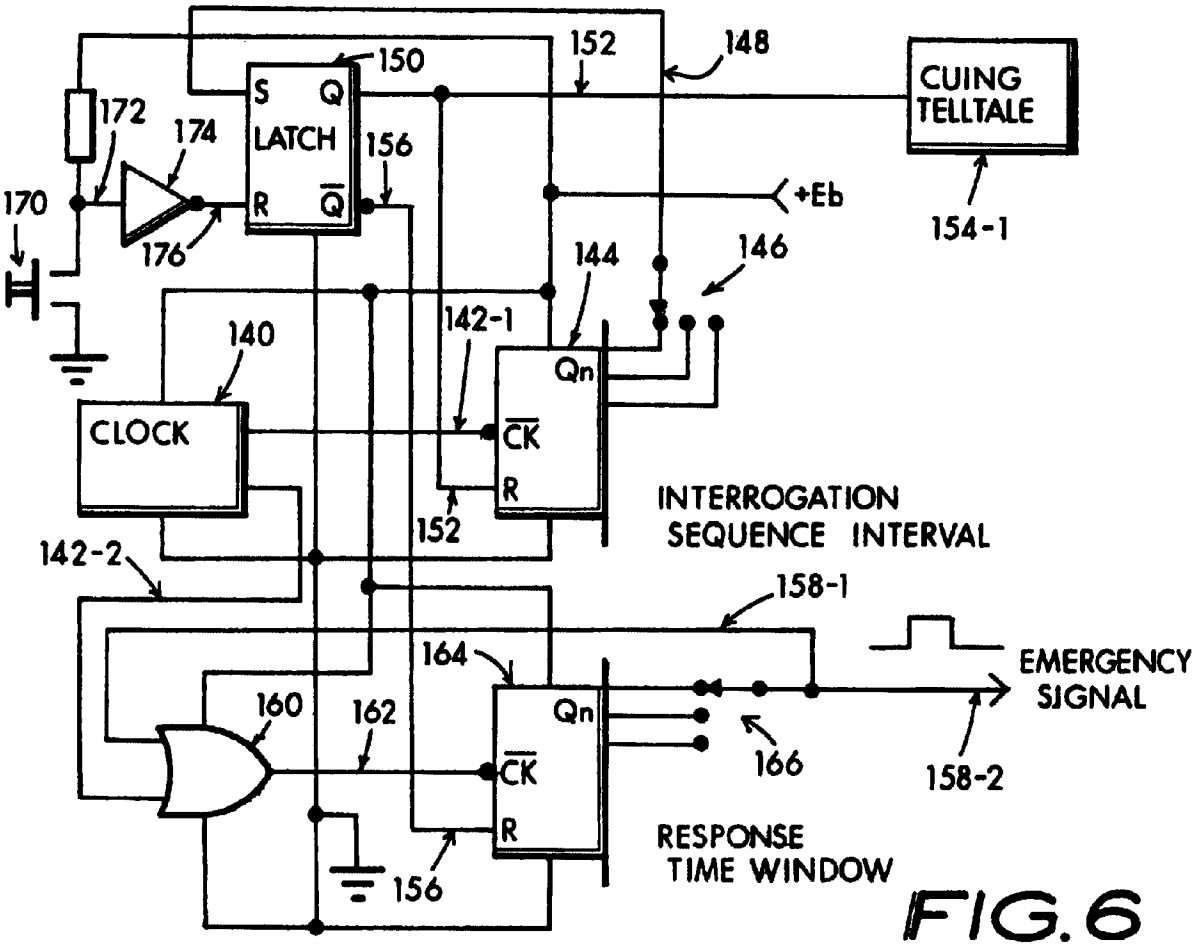
FIG. 6—Interrogator showing interrogation sequence timer and response time window timer functions, together with decisive logic for determining timely response or emergency state.

With FIG. 6 I show the clock 140 providing a clock signal coupled 142-1 with the /CK input of a multistage counter 144, such as the earlier mentioned CMOS family (e.g., CD-4020, CD-4040, etc.). While the counter 144 is singularly shown, it may comprise a cascaded plurality of counters providing a substantially higher division factor. I depict several outputs from the counter 144 any one of which may be preselected by a switch 146 to deliver their respective output on line 148 as looped to a SET input of a latch 150.

The functional intent of this portion of my invention is to provide a determinable time period usually selected to extend between about a half-hour or less, and upwards to perhaps twelve or twenty-four hours whereupon the latch 150 is "set" delivering a HIGH state on line 152 coupled from the Q output of the latch. This line 152 signal extends to a cuing device 154 which may visually, audibly or otherwise signal the user that a manual response is necessary to avoid setting off an emergency hailing mode.

The HIGH state developed on line 152 also couples with the RESET input of the counter 144 resetting the counter's output lines to to a logic "0" state and inhibiting count advance even in presence of a continuum of clock pulses flowing forth on line 142-1.

The "set" latch 150 also delivers a LOW state on line 156, which of course was HIGH prior to setting. This LOW state signal on line 156 couples with the R (RESET) input of a counter 164. As mentioned in regards to the counter 144, this counter 164 may include one or more separate counter devices in cascade.

The presented LOW state on the RESET line effectively enables the counter 164 to advance through its register states. The clock 140 provides a clock signal on line 142-1 as coupled to one input of an OR gate 160, while the other input of the OR gate is enabled by presence of a LOW state on line 158-1. As a result, the clock signal conveys over line 162 to the /CK input of the counter 164 resulting in a dutiful advance of count states in the counter 164.

Several higher-order Qn outputs are shown coupled with a selector device 166 which may be preset by the user or another to impress the corresponding output from the counter 164 onto line 158-1. Hence, when the counter advances to a point where the selected Qn output line 158-1 is driven HIGH, the state "1" level is coupled with the input of the OR gate 160 maintaining the OR gate line 162 HIGH and serving to inhibit a furtherance of clock signal conveyance to the /CK input of the counter 164. In effect, the counter locks-up or latches at the count level where the selected output line 158-1 shifted HIGH.

An emergency signal having a state="1" conveys forth from the line 158-2 to an emergency dialing or hailing device such as shown in FIG. 5 and FIG. 6 and shown as the line 54 associated therewith. A practitioner of this invention must realize that I have elected to presently depict the circuit functions in the form of discrete circuit elements to clarify their interdependent operation. My intent is that many of the circuit functions may be satisfied by a combination of microprocessor hardware elements and software instructions as is well known in the art.

For the most part my hailing device exhibits two principal operative modes: an active (activated) mode and an abeyant mode. This may be further extended to include a hailing mode brought on by a user's failure to respond to the active mode on a timely basis.

Figure 7:
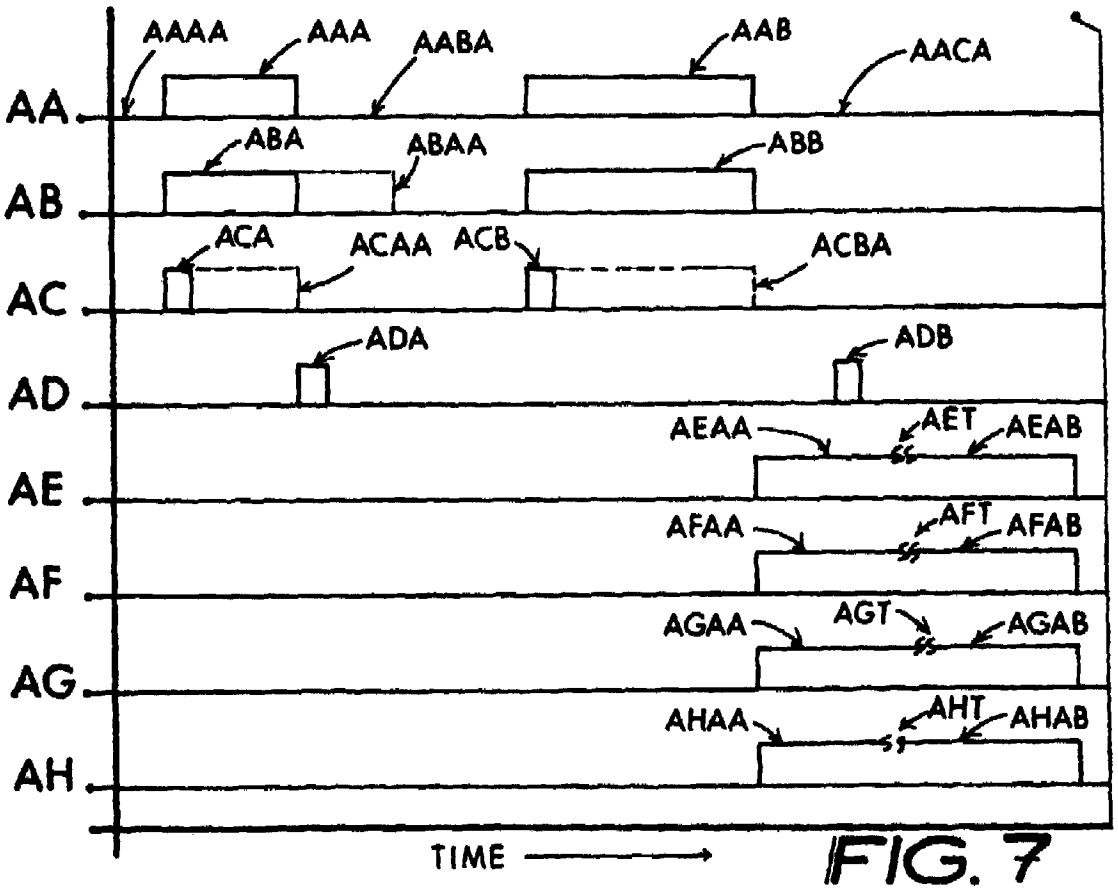
FIG. 7—Timing diagram associated with FIG. 6.

A graphical presentation shown in FIG. 7 depicts the interrelated timing of these various modes and events characteristic of my hailing device. Observe line AA to include several "abeyant" modes AAAA, AABA and AACA. Active mode states are also shown AAA, AAB as typified by a HIGH state 125 appearing on line 148 of the predecessory FIG. 5. The duration of the abeyant mode time interval is principally determined by a time-sequencing function depicted earlier by counter 144.

Coincident with the active modes shown on line AB is a first timing interval ABA shown extensive to ABAA, and a second timing period with an overall duration ABB. These periodic time lapse representations establish an overall sequence of events defining intervals established by the timer function provided by the earlier mentioned counter 144.

Cuing of the user is depicted on line AC to include a brief cue ACA, ACB such as an audible "beep", or a more lengthy cue (such as showing a light) extensive to ACAA as determined by the cuing device 154.

A manual response by the user is subsequentially submitted as depicted on line AD by the actions ADA and ADB as presently suggested by the signal state shift actions now shown on line 176 of FIG. 5. A principal difference appears between these response happenings. The response entry ADA is timely. The response entry ADB is tardy. As a result the timely response ADA serves to resets the latch 150 and terminates the active mode interval AAA and the first timing interval ABA, as well as curtailing the otherwise maintained cuing signal 152 interval ACAA coincident with initiation of the manual acknowledgment by the user ADA.

Conversely the tardy submission by the user ADB is submitted after a completion of the active mode AAB time period ABB defined by the advancing of counter 164. As a result an emergency signal AEAA is initiated on line 158-2 and it may continue AET for a duration AEAB until the intent of the emergency signal is satisfied. In a practical usage of my invention's teaching, a total absence of an client (user) entered reply by actuation of switch 170 otherwise shown here as a belated reply ADB is mostly equivalent to an indefinitely tardy submission, with essentially similar results.

An embodiment of my hailing device may be devised as a wearable appurtenance which I later depict in FIG. 20 and FIG. 21 and which is coupled to a base station monitor, using known wireless techniques. Realize that wireless coupling for distances of 100 to 150 feet are entirely practical, as demonstrated by prior art devices such as described earlier in conjunction with the prior-art's commercially available LifeAlert™ or Telemergency™ "panic button" alarm device.

In the present arrangement of FIG. 7, the signal on line AE is in effect an "alert signal" earlier said provided by a presence of the emergency signal appearing on line 158-2 and which may be transmitted as an encoded wireless signal shown on line AF to include portions AFAA, AFAB extensive by time AFT and correspondingly received as shown on line AG including portions AGAA, AGAB extensive by time AGT. Note that these various timings are shown as nearly coincidental but in practice may be variously related to one-another in time, so long as the functional requirement of conveying an emergency state is satisfied.

Now find that the signals on line AG also serve to initiate the emergency signal or hailing signal depicted on line AH as portions AHAA, AHAB extensive by time AHT. In accord with practice of my teaching, I say that the alert signal on line AE, the transmitted signal on line AF and the received signal on line AG are successively intent to give rise to the emergency signal depicted on line AH the duration of which may surpass the duration and scope of any of the precedent signals.

Figure 8:
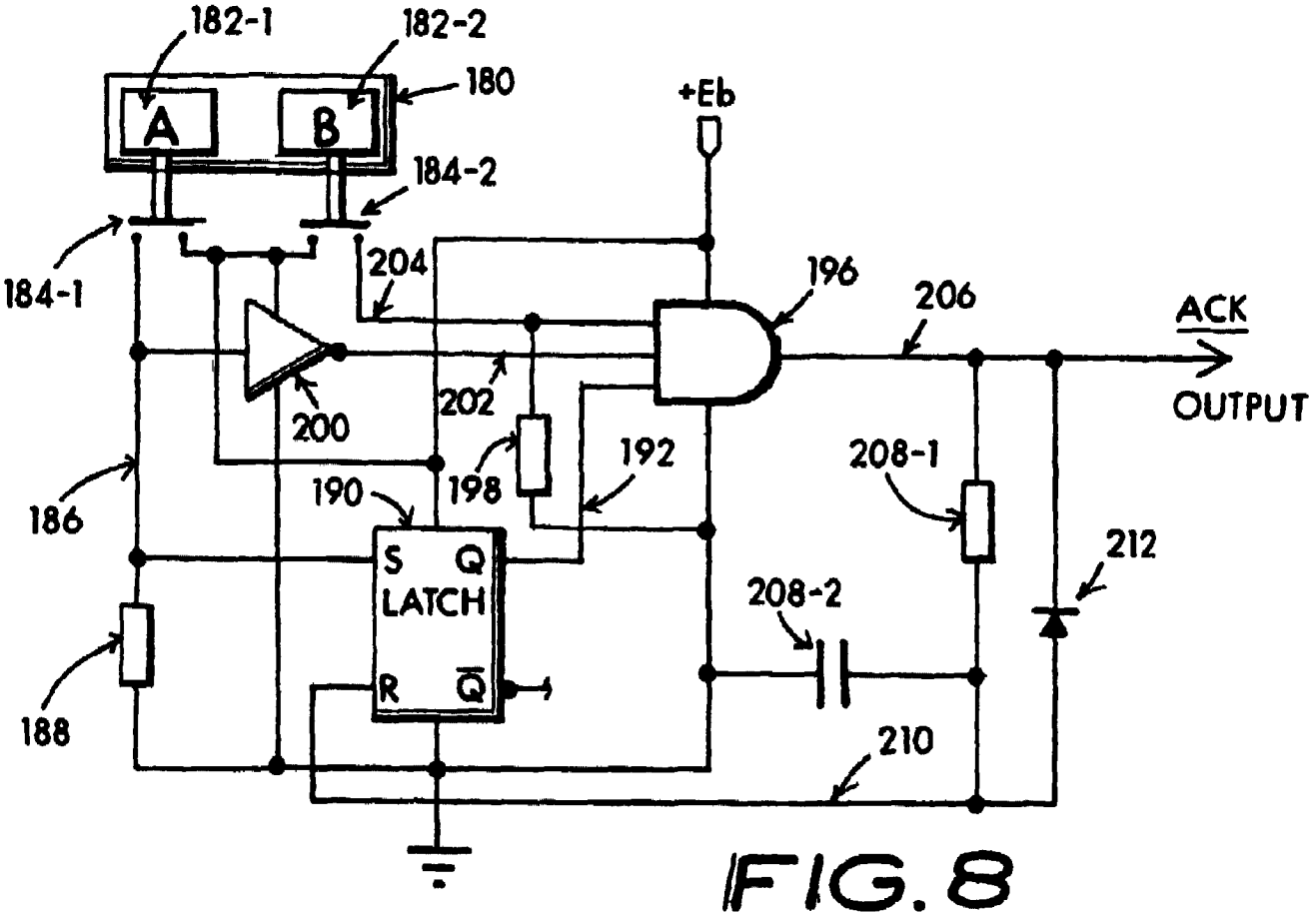
FIG. 8—Responsion button scheme where buttons have to be pressed in proper sequence or determination of an emergency state prevails.

In FIG. 8 I depict two separate momentary action keybuttons 182-1, 182-2 marked "A" and "B" and associated 180 to actuate correspondent switches 184-1, 184-2. The sequence of events established by this configuration is determined to "check out" a user's response validity beyond merely "hitting the button". In operation, the user presses the keybuttons in a sequence. Press "A" first, then press "B" quickly thereafter. This sequence and short timing may establish a user's relative condition. For example, it unlikely that a semi-conscious or stunned user will conform with the necessary sequence and timing. On the other hand, a mere "button press" might occur as a reflexive response, while the user may actually be in need of attention by a care-provider. Further constraints on button operation, such as physically positioning the buttons 182-1, 182-2 apart may assure even further response discrimination.

Operation of FIG. 8 occurs when button "A" 182-1 is firstly pressed, manually closing switch 184-1 and conveying a HIGH state to the SET input of a latch 190 as well as the input of an inverter 200. The HIGH state coupled with the SET input of the latch 190 similarly sets the Q output line 192 HIGH as coupled with an input of an AND gate 196. The inverter 200 recognizes the closure of switch 184-1, delivering a LOW state on line 202 as coupled with a second input of the AND gate 196. Recognize that the remaining AND gate input line 204 is maintained LOW through a pull-down resistor 198. When the button "A" 182-1 is released the line 186 is pulled LOW by the pull-down resistor 188. This enables the inverter 200 to deliver a HIGH state on line 202 coupled with the AND gate 196.

However, the line 204 is remaining LOW and the AND gate 196 is still disabled with the output line 206 remaining LOW. Observe that the LOW state on line 206 also couples via diode 212 with the RESET input of the latch 190. When the client/user subsequently presses the button "B" 182-2, a HIGH state delivers 204 to the AND gate and the result is the gate's input states are satisfied to produce a HIGH state on line 206, as subsequently coupled with an output ACK and a resistor 208-1. The combination of the resistor 208-1 and capacitor 208-2 embodies an integrator as a pulse stretcher, slightly delaying the HIGH state-delivery from line 206 to the latch RESET line 210. The delay afforded by the integrator's time constant determines the duration (pulse width) of the output state line ACK.

Figure 9:
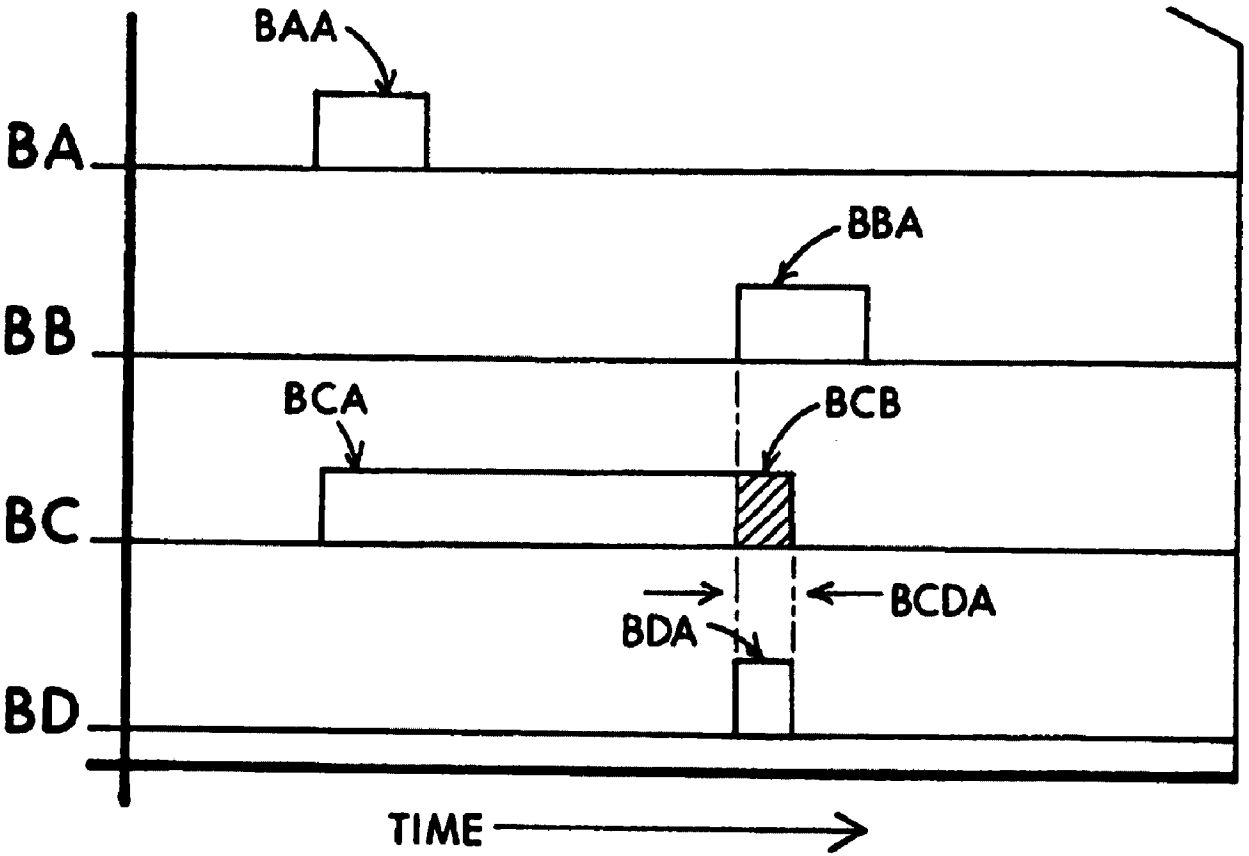
FIG. 9—Timing diagram associated with FIG. 8.

This sequential button action is apparent from the signal states represented on FIG. 9. The first button "A" (182-1 of FIG. 8) is shown pulled HIGH BAA on line BA. This onsets the latch 190's output state HIGH as depicted BCA on line BC. A subsequential pressing of the button "B" (182-2 of FIG. 8) delivers a HIGH state BBA on line BB. Coincidence between the held state on line BCA and the recent button "B" press shows a coincidence BCB which, in effect, determines the occurrence and duration of the output (ACK) signal state BDA (line 206 of FIG. 8).

Figure 10:
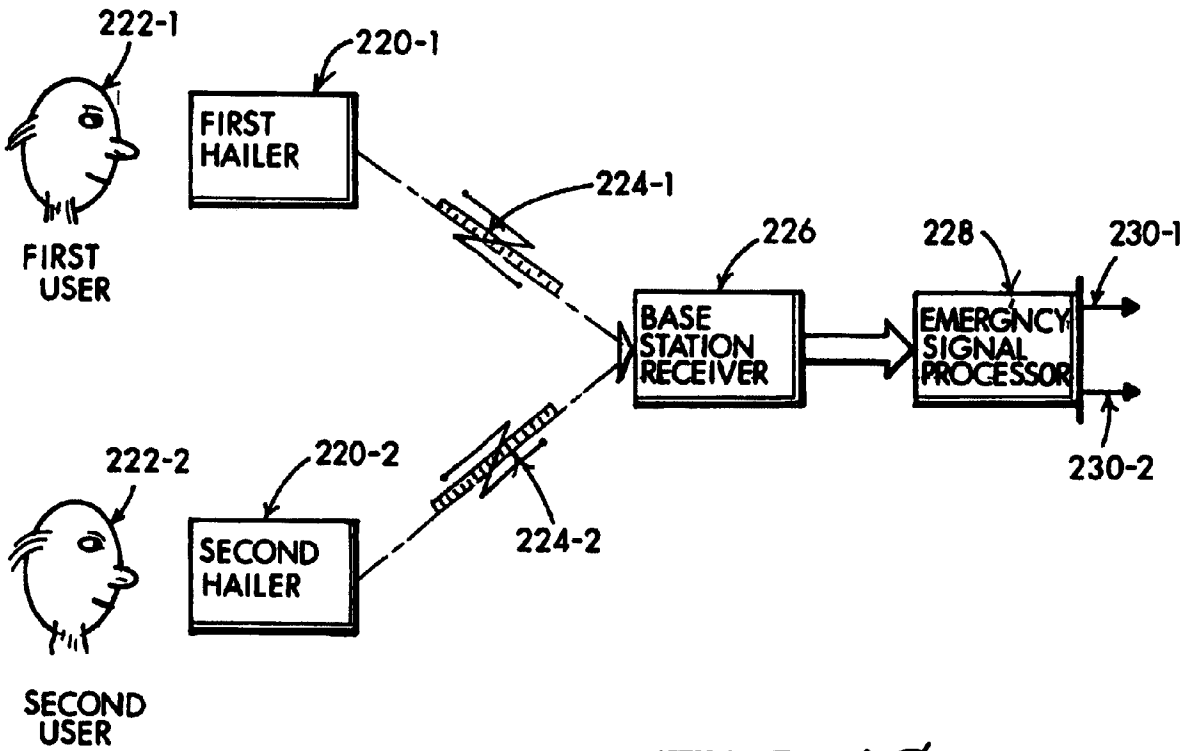
FIG. 10—Depiction of a shared base station serving more than one user.

With FIG. 10 I show two users 222-1, 222-2 each equipped with a separate first emergency hailer 220-1 and second emergency hailer 220-2. Each of the emergency hailers are functionally similar and separately send a wireless alert signal, such as shown previously in the earlier graph of FIG. 6 as the signal on line AF.

The wireless signal 224-1 sent by the first emergency hailer 220-1 is uniquely encoded relative with the uniquely differential encoding associated with the wireless signal 224-2 sent by the second emergency hailer 220-2. Each of the user's encoded wireless alert signals are similarly intercepted and recognized by a base station receiver 226, delivering the received alert signal to an emergency signal processor 228. The conclusive result of these conditional events is a development of an emergency signal now on line 230-1 or line 230-2 and intended to show correspondence with an emergency situation associated with either of the users 222-1 or 222-2.

Figure 11:
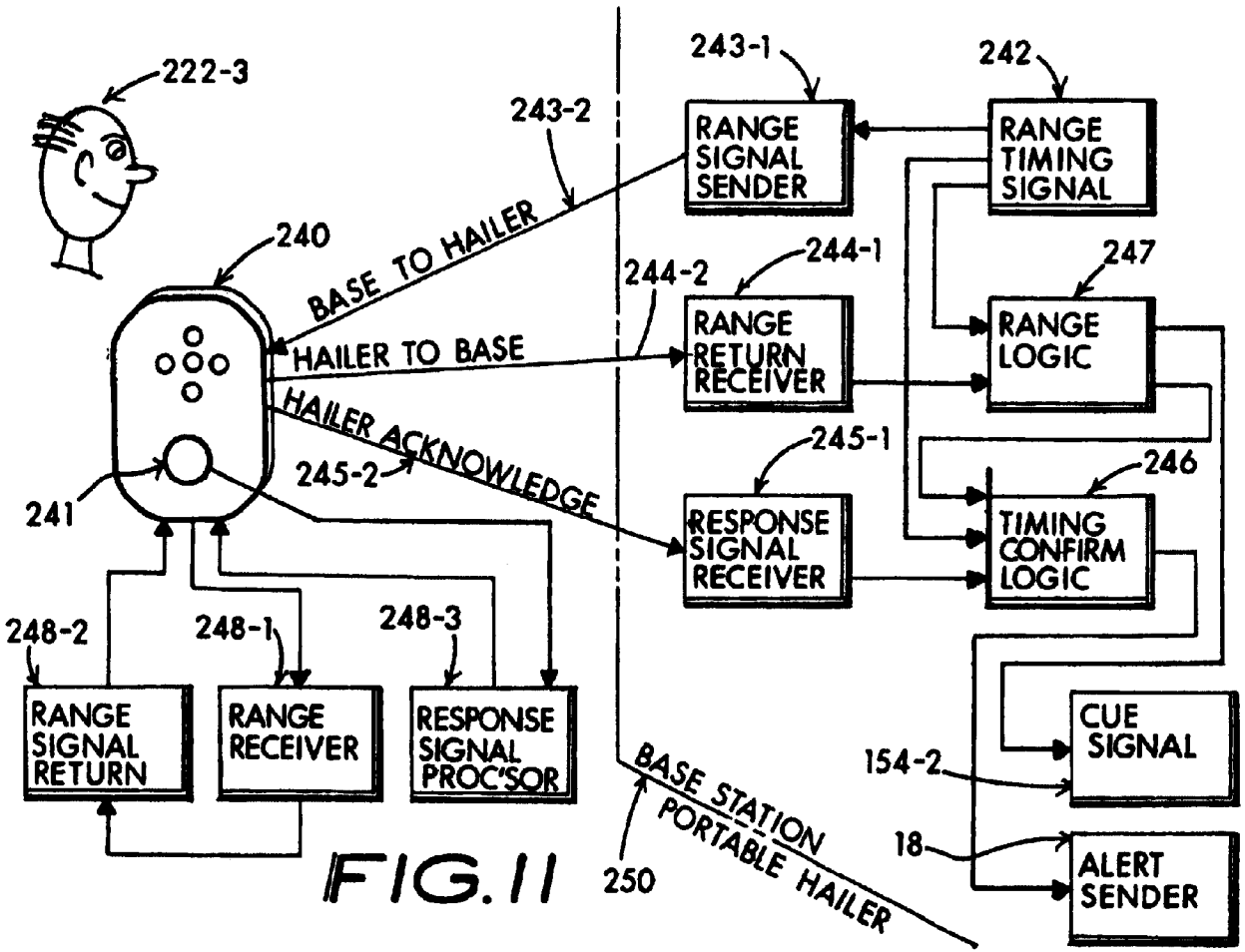
FIG. 11—Depiction of basestation strobing of a wearable hailing device in order to maintain integrity of interrogation.

As a practical matter, the user of the portable hailer may on occasion venture "out of range" of reliable hailer operation. For example, a protected user may "go shopping", visit a friend, attend a movie or undertake any of a variety of activities that might take him or her away from the operational territory of the base station. As a result, a false emergency alarm may occur. To prevent the likelihood for false alarms, the user may be equipped with a bidirectional hailer and base station arrangement depicted in FIG. 11.

The user 222-3 is ordinarily provided with an interrogative hailer 240, often worn about the neck as a pendant or bob, or else on the wrist as a bracelet. To complete the system aspect of this arrangement, a base station 250 is also included in the setup. The base station originates a send range signal 243-1 which couples via a wireless technique 243-2 with the user-worn interrogative bob device 240. The signal received on line 243-2 couples with a range receiver 248-1 which amongst other processing steps, loops a portion of the received signal back through a range signal return (sender) 248-2. As a result, a range signal is returned 244-2 in response to any range signal received over the coupling link 243-2. Thus the range signal sent 243-2 from the base station (to the hailer) is ordinarily echoed back 244-2 from the user's interrogator to the base unit 250. A range timing signal function 242 produces the original sent-signal format as coupled with the range signal sender 243-1. It also couples a timing signal with a range processor function 247 that in effect verifies the validity of the return signal and subsequently produces a cue signal 154-2.

Ordinarily, upon being cued, the user immediately actuates a pushbutton switch 241 or the like during the WRE period to acknowledge 248-3 the cue and maintain the system in an abeyance (e.g., quiescent) mode. The user-worn interrogator 240 subsequently sends an acknowledge signal 245-2 to the base unit. The acknowledge signal is received 245-1 by processing circuitry which confirms the acknowledge signal timing, in conjunction with a valid state received from the range processor and timing signals from the range timing signal function 242.

In a manner similar to that which was described relative with FIG. 1 and FIG. 6, a timely return of an acknowledgment signal during the WRE through the efforts of the user holds the system in abeyance, whilst a belated acknowledgment signal response urges the system to issue an emergency signal. A depiction of the events associated with this bidirectional retro-responsive system having "out of range" failsafe protection next appears in FIG. 12.

Figure 12:
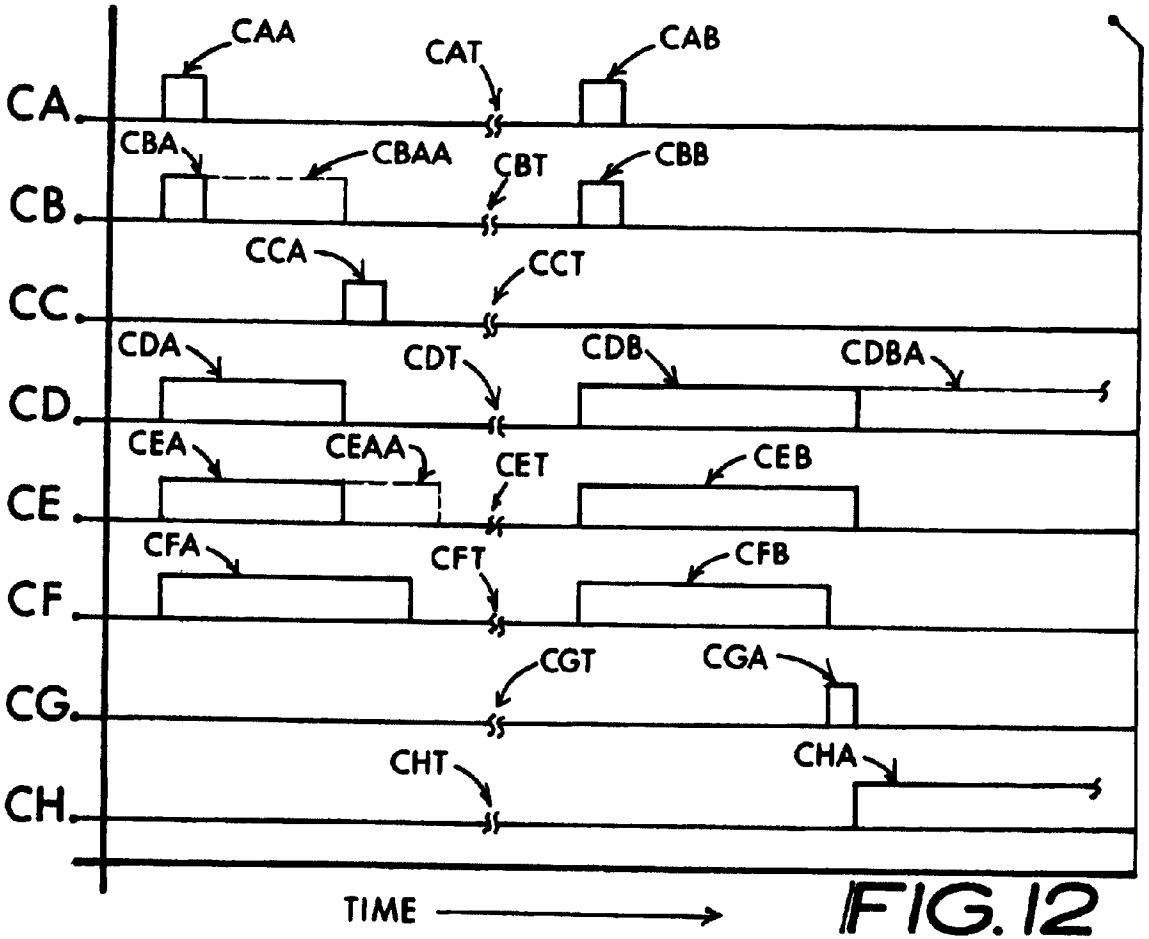
FIG. 12—Timing diagram associated with FIG. 11.

FIG. 12 teaches a furtherance of my device to include a provision for sending a first wireless signal CAA on line CA from a local base station to a portable interrogator ordinarily worn by the protected user. A local base station is ordinarily a portable "table-top" device which has provision to:

1. Couple with a telephone line.
2. Couple with a local alarm device (optional).
3. Send and Receive Wireless signals.
4. Signal a Cue Telltale.

The wireless signal CAA is received by the protected user's interrogator and results in a cuing signal CBA shown on line CB which may either be of brief duration, or of longer CBAA duration.

The user responds to the cue telltale with a second wireless signal, or manual acknowledgment signal, CCA which is sent during the WRE period from the user's usually worn interrogator. In this embodiment, the interrogator may be in the form of a pendant or bracelet for convenience.

Simultaneous with sending the first wireless signal CAA, the base station may include a latch which is set-up CDA on line CD typically for the duration of time between the onset of the first wireless signal CAA and the onset of the user's WRE response CCA. Ordinarily this latch set-up supports a first timed interval CEA on line CE. The timed interval may have a preset duration of CEAA, but it is terminated when the user responds CCA. The maintained time interval CEA defines "how long" the user actually took to respond. At the same time a first reference time interval CFA on line CF initiates when the cuing signal CAA is sent to the user.

Operationally, if the user responds CCA quickly, before the time interval CFA completes, the user is considered in satisfactory condition and no further action results.

Conversely, if the user is sent a wireless cuing signal BAB which serves to cue the user CBB and no response is made by the user (or if the response is extensively delayed) as depicted on line CC subsequent to lapse CCT the local latch on line CD is maintained and the timer is maintained CEB for a full duration which exceeds that of the reference time interval timer CFB. As a result, an emergency signal is produced CGA on line CG and a hailing signal CHA on line CH is delivered. The hailing signal, as indicat d earlier, may include dialing a telephone number, sounding an alarm or setting of flashing lights, for example.

As I show, substantial lapse in time CAT, CBT, CCT, CDT, CET, CFT, CGT and CHT may occur between interrogative events initiated by the first wireless signals CAA, CAB for example.

The invention provides for still a further advancement, in that the looped-back ranging includes return signal failure detection to reduce likelihood for false emergency signals. On line DA of FIG. 13, a succession of encoded range signals DAA,DAB,DAC are periodically sent from the base station to the hailer. The intercepted range signal is immediately and automatically returned DBA,DBB from the hailer to the base station. Immediate with the onset of the sending of the range signals DAA,DAB,DAC a response timer is enabled at the base station, represented by signal periods DCA,DCB,DCC. A latch is further set on line DD immediate with the sending of the base station originated range signals DAA,DAB,DAC and terminated immediately upon receipt of the automatic return signal DBA,DBB from the hailer. A cue signal DDA,DDB (audible, visual, etc.) is submitted as shown on line DD to the client/user immediately upon return of the range signal from the hailer.

The user is urged by the cue to press a button or otherwise activate an acknowledgment signal shown on line DF as a timely return signal DFA or a tardy return signal DFB. Line DG depicts a tracking latch which is set when the range signal is sent from the base station to the hailer and resets when the user presses the acknowledgment button or otherwise returns. Observe that if the acknowledgment is timely DFA, occurring within the period of the response timer period DCA and found to be where DFTA is shown to be:

$DFTA>0$ where $DFTA=DTCHA-DTCFA$ the requirement for a timely return is satisfied and the holding latch of line DG is truncated DGA. As a result, signal states on lines DI and DJ remain silent. Furthermore the interrogation sequence timer, depicted by the state signal DHA on line DH commences.

If the user/client submits a belated acknowledgment of the cue signal, shown as the return entry DFB on line DF, a different sequence of events is introduced. While the outgoing and return range signals DAB,DBB, the response timer interval DCB and cue signal DDB function similarly, it is the acknowledgment signal DFB that is wrongly returned later than the time period DCB. Recognize that the holding latch extends past the timeline DTCHB. As a result a coincidence is recognized between the conclusion of the time period DCB and th extended pulse DGB presented by the holding latch. This might be defined by:

$DFTB>0$ where $DFTB=DTCFB-DTCHB$ and the acknowledgment return is found lacking in timeliness. As a result, the holding latch true level extends beyond a conclusion of the response timer interval DCB. This event enables onset of a signal pulse DIA on line DI, indicative of conditions that may reflect an emergency. The signal DIA may subsequently deliver an emergency signal, e.g., an alarm or a call to a care-provider or other party.

Looking further now to the sending of a ranging signal DAC from the base station so as to interrogate the hailer no return is received from the hailer, as would ordinarily appear on line DB. As shown, the response timer true state DCC occurs, having been initiated by the outgoing range signal DAC delivered from the base station. Observe now that the latch signal DDC continues unabated, since it is not reset by the expected signal returned from the hailer as would ordinarily appear depicted on line DB. Similarly, since no hailer signal returned no cue signal was presented to the user and thus the user obviously did not acknowledge the lack of a cue signal; e.g., no signal appears on line DF and thus the latch state DGC continues true past the end of the response timer period DCC. What is found is that a coincidence between the true state of the signal DDC extension and that of the signal DGC extension, while coincident with the interrogatory period DHC delivers an interruptive signal DJA on line DJ that may be used to put the system in a quiescent state for the duration of time until another returned ranging signal appears on line DB.

Figure 13:
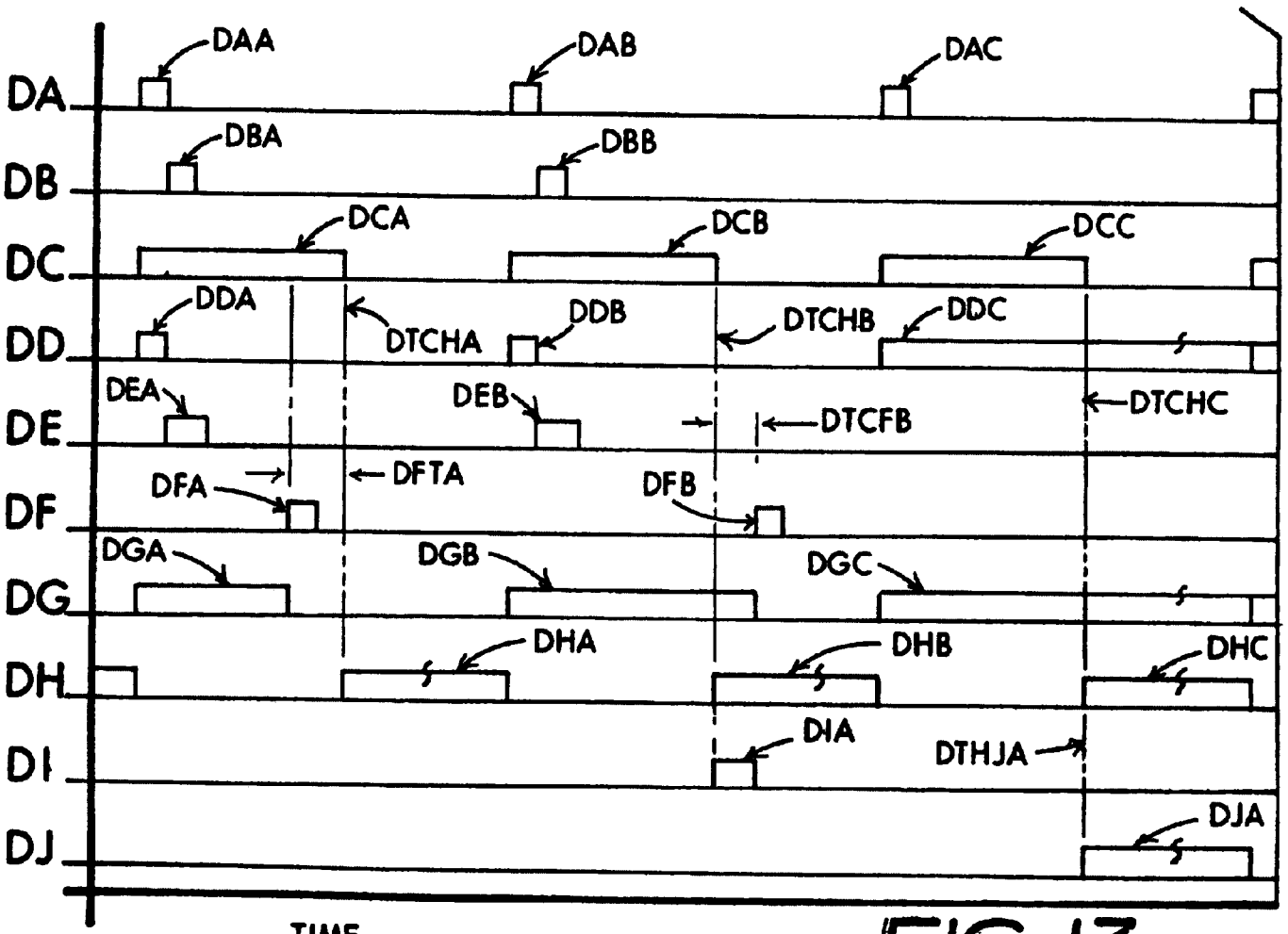
FIG. 13—Timing diagram associated with FIG. 11.
Figure 14:
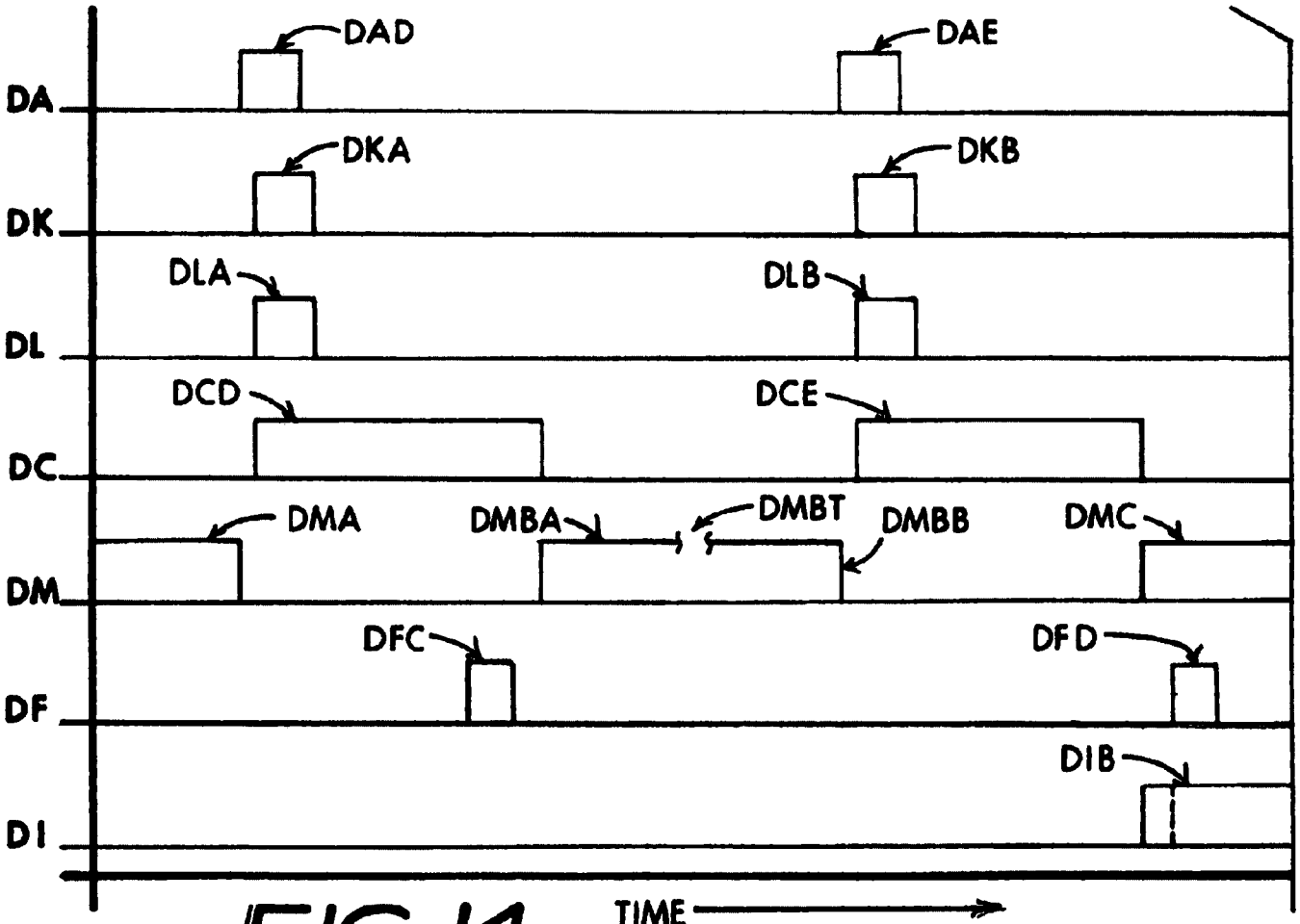
FIG. 14—Timing diagram associated with FIG. 11.

Looking now at the graphical representations of FIG. 14 which shall be treated as an extension of FIG. 13 where we may find a further succession of encoded range signals (on line DA extended from FIG. 13) DAD,DAE which are periodically sent from the base station to the hailer, 8 as previously mentioned. The line DK then depicts the return or bounce-back of the base-to-hailer signals DAD,DAE as correspondent signals DKA,DKB. The signals on line DK are the direct result of a reception of the signals DAD,DAE by the hailer and will not be developed if the hailer fails to receive the hailing signals DAD,DAE such as when it is out-of-range. The cue signal on line DL also occurs coincident with the reception by the hailer of the base-to-hailer signal. Hence the cue signal DLA,DLB mostly corresponds with the received signals DAD,DAE or more perfectly with the returned hailer signals DKA,DKB.

The onset of an acknowledgment timer signal DCD,DCE occurs on earlier mentioned line DC. A completion of the acknowledge timer signal DCD,DCE serves to initiate the next-event-timer periods DMB,DMC where signal signal DMA's trailing edge serves to initiate the next base-to-hailer signal DAD, for example.

The user's responsibility is to acknowledge the hailer's cue signal DLA within the time window (WRE) DCD by an manually initiated signal DFC. In event the user fails to acknowledge the hailer's cue signal DLB for example, during the time window DCE by either returning the acknowledgment signal DFD "late" or not at all, an emergency signal DIB is developed on line DI.

Figure 15:
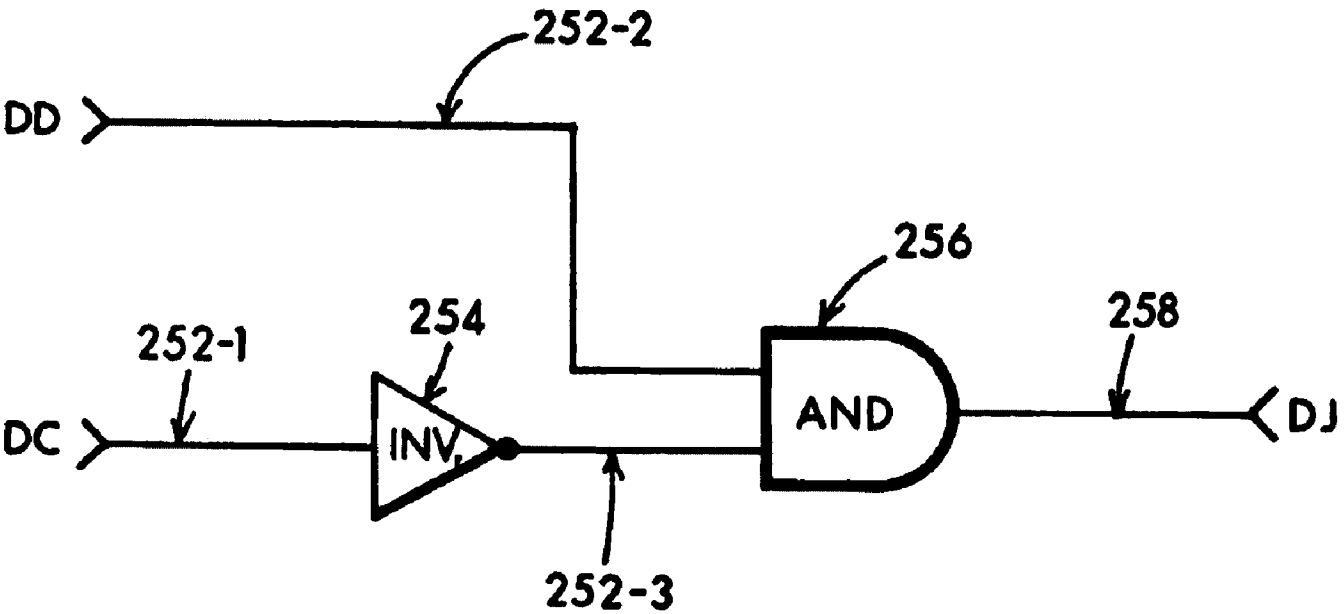
FIG. 15—Combinatorial logic.

To find the signal DJ an illustrative logic arrangement like that of FIG. 15 might be used where the false (LOW) state of signal DC couples 252-1 through an inverter 254 with an input of an AND gate 256. Similarly, the signal present on line DD couples 252-2 to the other input of the AND gate 256. As a result, when line DD is LOW such as following signals DDA,DDB the DJ output 258 from the AND gate 256 is maintained LOW. However, when the coupling between the base unit and the remote hailer fails and the signal DAC is not returned on line DB, the state DDC of line DD remains TRUE (HIGH) past the end of the timing signal DCC. The result is that where:

| DC | DD | DJ | |
|---|---|---|---|
| 0 | 0 | 0 | |
| 1 | 0 | 0 | |
| 0 | 1 | 1 | Signal DJA appears HIGH |

Figure 16:
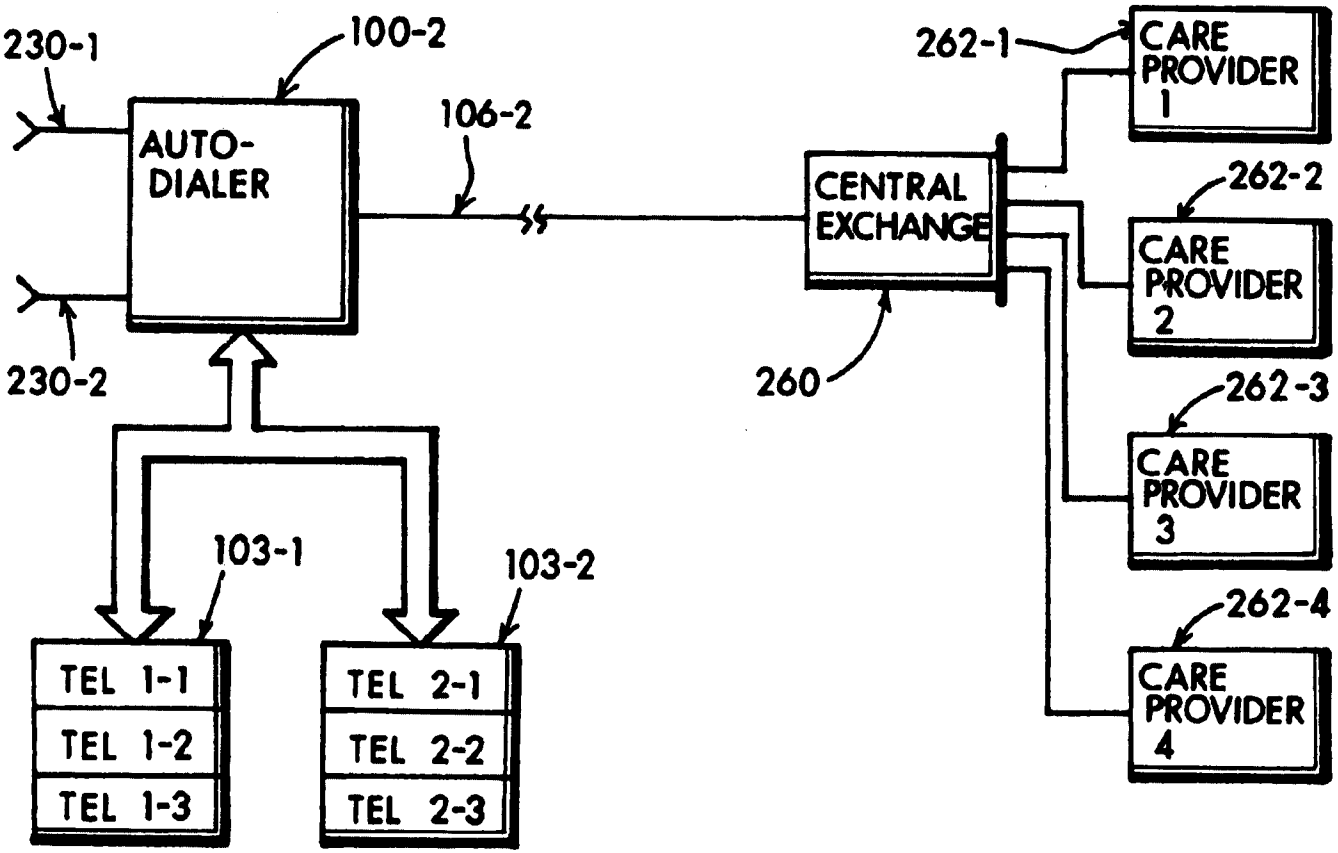
FIG. 16—Autodialer for calling separate library of care-provider combinations for each one of several shared users of FIG. 10.

In FIG. 16 an autodialer 100-2 includes two inputs 230-1 and 230-2 derived from the multi-user configuration said for FIG. 10. What this shows is that two different combinations of emergency telephone numbers 103-1, 103-2 may be handled. This provides for a different combination of care-provider notifications for each of the users of FIG. 10. As mentioned earlier for FIG. 3, the autodialer may couple with a telephone exchange 260 which services any number of telephone destinations 262-1,262-2,262-3,262-4 designated as care-providers #1 through #4 respectively. For this example, the calling numbers for user "A" as r presented by the calling number file 103-1 might be care-providers #1,#3 and #4 whereas the other user "B" represented by the file 103-2 may automatically call care-providers #1,#2 and #3. Obviously other combinations of care-providers may be handled merely by variously designating their telephone number groupings in the files 103-1, 103-2.

Figure 17:
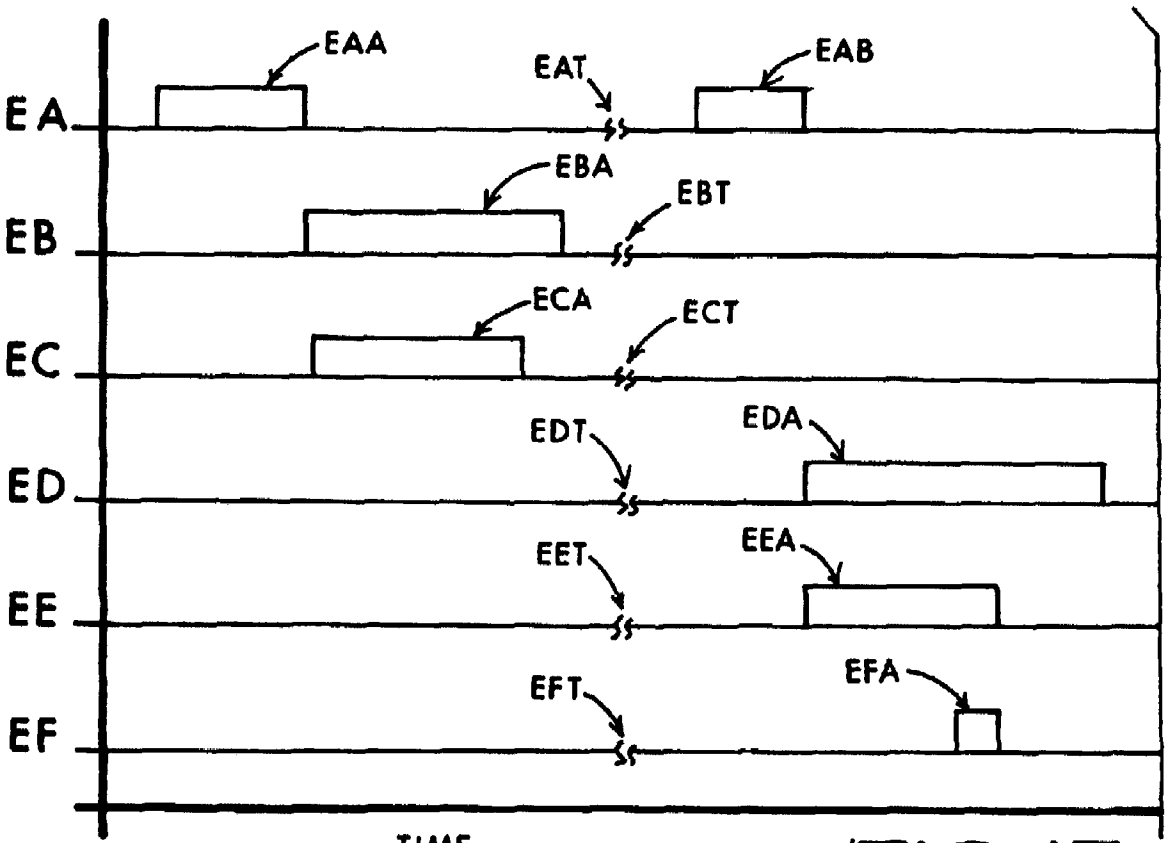
FIG. 17—Timing diagram associated with FIG. 16.

To safeguard the user in event of an unavailable care-provider being called, the signal handling of FIG. 17 shows that a care-provider must verify the incoming emergency call or otherwise the next care-provider in the stack of calling numbers 102 of FIG. 3 is called, by way of example. What occurs is that the auto-dialing of care-provider #1 is appears EAA on line EA. The call is subsequently picked-up EBA by the care-provider's telephone. Concurrently a time window is initiated ECA at the autodialer during which the care-provider should acknowledge the incoming call, usually by pressing one or more Touchtone™ keypad entries. In event the care-provider is "out" and an answering machine perhaps answers the incoming emergency call EBA, no acknowledgment signal is returned during the timing period ECA. This provision overcomes several failings of the prior art, including:

an incoming call being intercepted by an answering machine;

an uninformed person answering (such as a baby sitter);

an incoming call being forwarded (call forwarding);

a facsimile machine picks up the incoming call;

a computer modem picks-up the incoming call; and, the autodialed number is out-of-service.

As a result of a failed acknowledgment by the care-provider, the autodialer move-on and calls the next on-file care-provider EAB. The care-provider #2 may now answer EDA and the timing interval EEA commences. If the care-provider #2 is present, an acknowledgment signal EFA may be returned to the autodialer and the emergency call is deemed to be satisfied.

Figure 18:
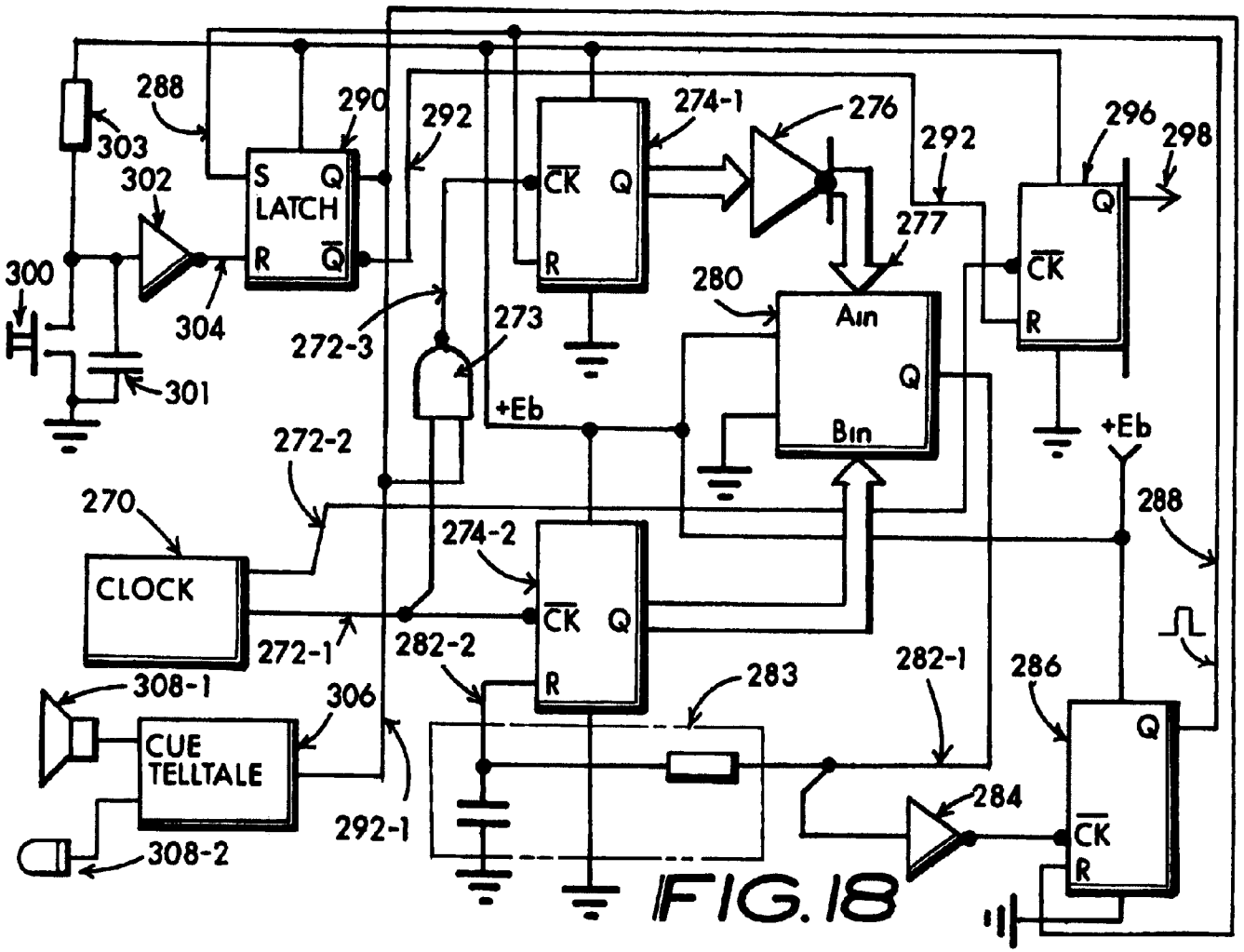
FIG. 18—Functional diagram for hailer system where the slower the response is to a cue, the sooner the next cue occurs and conversely a quick response to a cue introduces a longer period between cues.

A functional schematic for a variant example of my invention appears in FIG. 18. This particular embodiment teaches the inclusion of providing an automatic change in the abeyant mode interval lapsing between onset of active mode (i.e., cuing events) intervals. In this mode, the user is interrogated less frequently whenever he/she responds more quickly to the cuing telltale event. Conversely, if the user becomes laggard in responding, the abeyant mode interval between the active mode cuing events is decreased. In other words, a sluggish response brings about a more frequent interrogation. In effect, the period of the abeyant mode is inversely proportional to the time it takes for the user to respond to the most recent active mode cuing event.

PREFERRED CHANGE IN HAILING ACTIVITY

| RESPONSE BY USER | RESPONSE WINDOW | NEXT CUING EVENT |
|---|---|---|
| Same as previous | Nominal | Nominal |
| Quicker than previous | Shortened | Extended |
| Slower than previous | Nominal | Sooner |

The assumptive principle expressed by this methodology is that an alert user will quickly respond to a telltale cue whereas a less-alert, perhaps failing user, is apt to respond more sluggishly and may benefit from more frequently careful monitoring.

A clock 270 provides a timed-pulse signal on line 272-1 delivered to to each of the /CK (clock) inputs of two counters 274-1 and 274-2, whilst the other clock signal on line 272-2 delivers to the /CK input of a counter 296. Initially (during initial power-up) the RESET input 304 of latch 290 is briefly pulled-HIGH by the inverter 302 output as a modest-value capacitor 301 coupled to the inverter 302.input "charges" up from a LOW state (as applied to the inverter 302 input) through a resistor 303. The result is a RESET of the latch 290 resulting in a LOW state on line 292-1 and a HIGH state on line 292 as coupled with the R (reset) input of the counter 296. The counter 296 is reset, a LOW state appearing on the output 298.

At the same time, the LOW state on line 292-1 couples with the RESET input of counter 286, enabling the counter 286. Clock pulses on line 272-1 couple with the /CK input of the counter 274-2 and cause it to advance, since the R input line 282-2 is presently held at LOW state by the Q output of a comparator 280. As a result, the counter 274-2 counts "UP" as connected to the $B_{in}$ input of the comparator 280. Meanwhile, the output states of the counter 274-1 are inverted 276 as coupled with the $A_{in}$ input of the comparator 280. In effect, counter 274-1 becomes a "down counter" by virtue of the inverter 276.

During the first cycle (or turn-on initialization step) the comparator's $A_{in}$ inputs are dominantly HIGH state (e.g., 1111 for a 4-bit example) while the comparator's $B_{in}$ inputs are initially at a LOW state (e.g., 0000) from which they advance due to clocking on line 272-1. Hence the output of the counter 274-2 advances from 0000 to 1110 and one more count causing advance to 1111 causes a "match" in the comparator 280, resulting in a HIGH state on the comparator's Q output line 282-1. The HIGH state on line 282-1 couples via an inverter 284 to the /CK input of the counter 286, advancing the output state of the counter by "one step". An integrator network (delay network) 283 slackens the LOW to HIGH state transition on line 282-2 that couples with the RESET input of the counter 274-2.

Nextly, the count and compare action of the counter 274-2 and comparator 280 repeats manyfold, resulting in a series of pules on the /CK input of the counter 286 advancing it until a HIGH state occurs on the counter's Q output line 288 that routes back to the RESET input of counter 274-1.and the SET input of latch 290. As a result a HIGH state appears on the latch's Q output line 292-1. The HIGH state not only couples with the RESET input of the counter 286, but it also activates a cue telltale 306 to produce an audible 308-1 or visual 308-2 signal, or its subsequential equivalent.

The HIGH state on line 292-1 also enables the NAND gate 273 to allow clock pulses on line 272-1 to couple with the /CK input of counter 274-1, causing the reset counter 274-1 to advance counting.

Fundamental to this invention is the cuing of the user by the cue telltale provision 300. Once cued, the user (client) is expected to promptly respond by "pressing" a button associated with switch 300, or such equivalent act which may be appropriate for an individual application. As is the underlying intent of this invention, the cuing of the user should result in a quick response if all is well. Conversely, no response indicates something may be wrong. Additionally, a retarded response may indicate the onset of an issue not yet considerable as a problem (or a failing to respond).

When the switch 300 "closes" the inverter 302 output 304 goes HIGH resetting the latch 290 and hence by way of the LOW state introduced on line 292-1, inhibits the NAND gate 273 and locks-up the counter 274-1 at whatever count it achieved when the switch 300 becomes activated (pressed). The result is that the "count down" states on the $A_{in}$ input of the comparator 280 are altered.

Most simplistically, counters 274-1 and 274-2 "chase each other", producing various patterns of HIGH state occurrences on the line 282-1 from the comparator 280 Q output. Thus a quicker response in closing switch 300 subsequent to a cue results in a longer period between the HIGH state pulses on line 282-1, causing the interval timer 286 to advance more slowly. Conversely, a belated switch 300 closure may cause the $A_{in}$ states of the comparator 280 to be mostly LOW resulting a more rapid repetition of HIGH state pulses on line 282-1 and a shortening of the time between cue pulses delivered on line 292-1 to the cue telltale 306.

Hence, the more quickly the user responds to a cue, the less frequently the cues will occur (e.g., more time is allowed to lapse between individual cue events). Conversely, the more time the user takes to respond, the sooner the next cue will occur. The idea is to more frequently retest slowed-down user responses, because the slow-down in response may be indicative of an onset of a physical or mental faltering of the monitored user.

Figure 19:
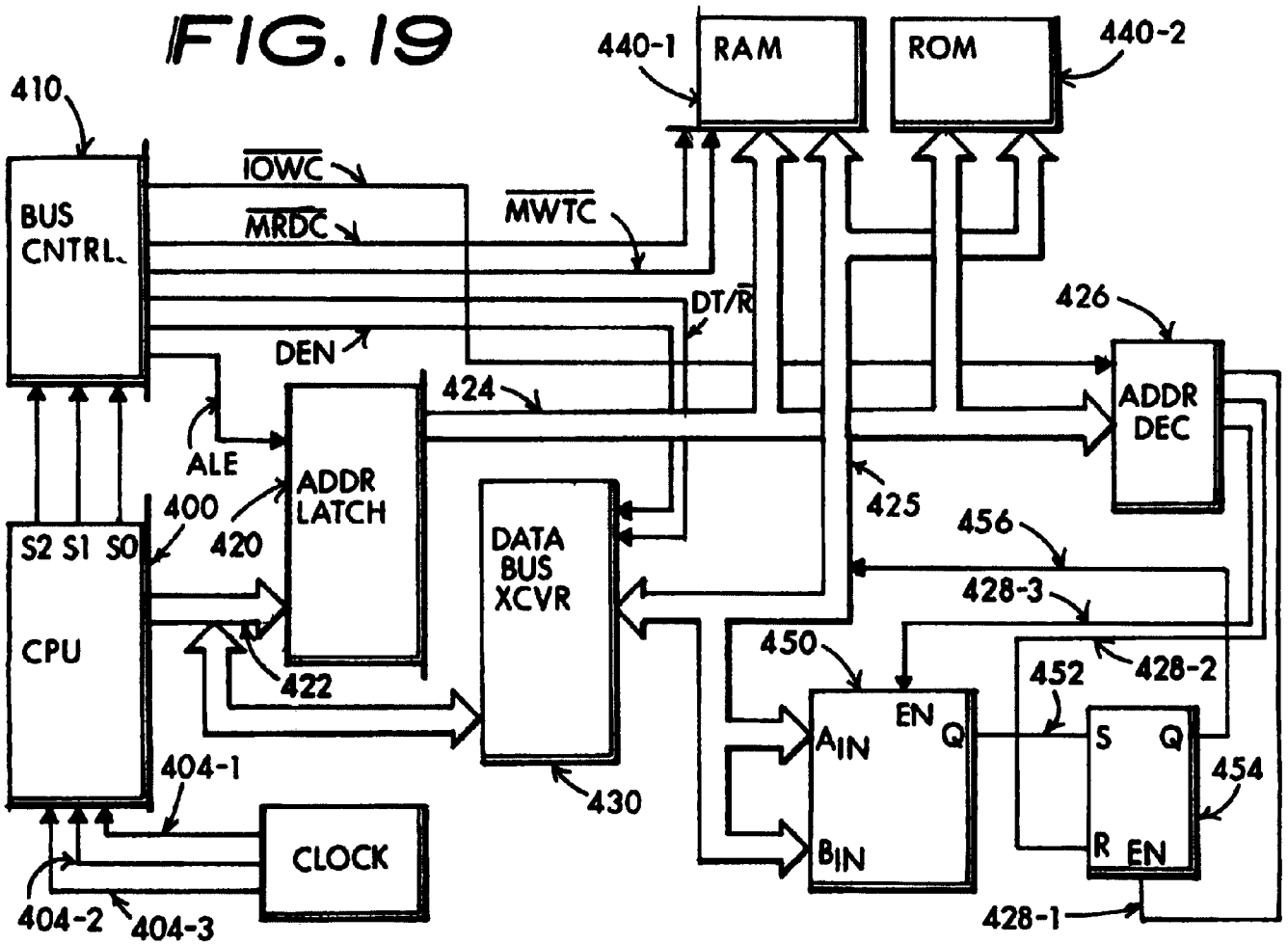
FIG. 19—Functional diagram for hailer system including features similar to FIG. 18 but implemented using micro-controller or microprocessor technological elements under the command of software instruction.

As shown with FIG. 19 my invention may be developed using a microprocessor. I have mostly depicted this invention using discrete circuit elements to achieve functional clarification. However a CPU 400 may be used in combination with other support elements. A bus controller 410 elivers an address latch enable ALE signal to an address latch 420, the output of which comprises the address bus 424. CPU clocking is obtained using a clock 402 having a CLK (clock) line 404-1, a RDY (ready) line 404-2 and an RS line 404-3 all coupled with the CPU 400. The bus control couples it's MRDC (memory read command) and MWTC (memory write command) control lines with a RAM 440-1. The address bus 424 appropriately couples with the RAM 440-1 and ROM 440-2. The ROM may hold control functions (machine language software) as well as the necessary program software operating the CPU and other elements. An address decoder 426 finds several binary address matches, one of which delivers a reset signal on line 428-2 to "reset" a latch 454, resulting in a logic 0 state on data line 456. A second address match delivers a signal on line 428-3 which enables a comparator 450.

The data bus couples with the AIN and BIN inputs to the comparator, which satisfies the function that:

IF A=B THEN Q=1 ELSE Q=0

When a HIGH state occurs on line 452, it SETS the latch 454 Q output line 456 HIGH, as coupled with the data bus 425. Timing is established so that the HIGH state on line 456 can be utilized by the microcontroller CPU 410 to count and store in the RAM.

The RAM delivers data over the data bus 425 to the inputs of the comparator. If the comparator 450 is a 4-bit wide device, allowing an 8-bit wide data byte to be "split" and compared. The trick is to utilize the MSB 4-bits and the LSB 4-bits as thought they were separate. Therefore we can consider the function of the comparator similar to the comparator 280 of FIG. 18, in that the inputs are "chasing" one-another and when equality is reached a HIGH pulse occurs on line 456. Software controls the counting, creating the virtual functions of the counters 274-1 and 274-2 of FIG. 18 to be simulated by the CPU and memory combinations of this FIG. 19. Functionally, the interval counter 286 timing and the emergency "wait-window" counter 296 functions of FIG. 18 also may be satisfied by software instructions delivered by the ROM 440-2 to the CPU 400. This approach (creating the virtual functions in the microprocessor) is well known art. The objective point of FIG. 19 is merely to depict that the functions may be mostly solved by software driven hardware elements.

Figure 20:
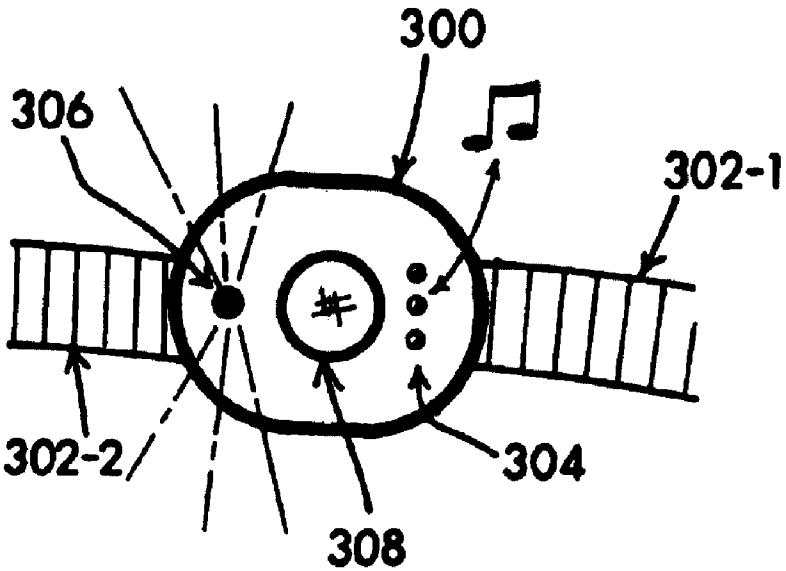
FIG. 20—Portable hailer embodied as bracelet.

A wrist-worn (bracelet) version of the remote hailer 300 is depicted in FIG. 20 to include a bracelet strap 302-1, 302-2 and is normally "worn" on the at-risk user's wrist. The hailer 300 includes the showing of two different telltale categories. A sounder 304 may emit a beep to cue the user, or else a light 306 may blink. The user normally responds by pressing a "pushbutton" 308, activating a switch to denote an acknowledgment in response to the telltale cuing signal.

Figure 21:
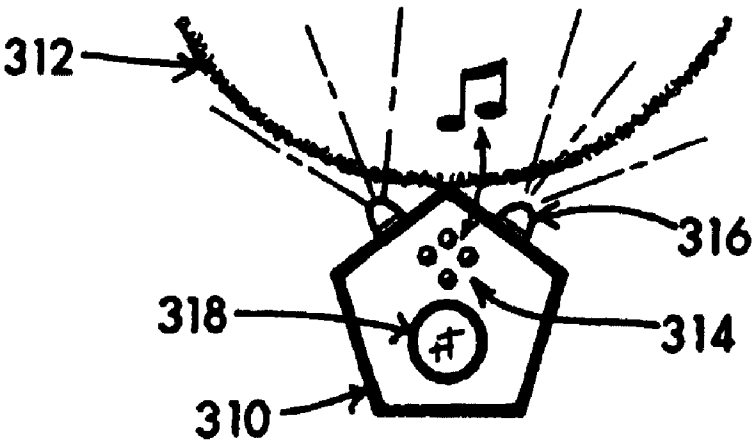
FIG. 21—Portable hailer embodied as necklace.

The remote hailer as shown now in FIG. 21 may also be worn as a bob 310 about the at-risk user's neck on a neck-chain 312. The bob serves as a containment for the hailer elements and includes the appropriate telltales as a "beeping" sounder 314 and a visible blink of a light 316, for example. Included also is a keybutton switch 318 used by the user to acknowledge response to a cue.

Although the remote hailer depicted in FIG. 20 and FIG. 21 show it worn as a "piece of jewelry", the remote hailer may of course be variously worn to produce the essential results of this invention. For example, an embodiment may be a "clip-on" device, a belt-worn device or carried in a purse and the equivalent results shall be produced.

Figure 22:
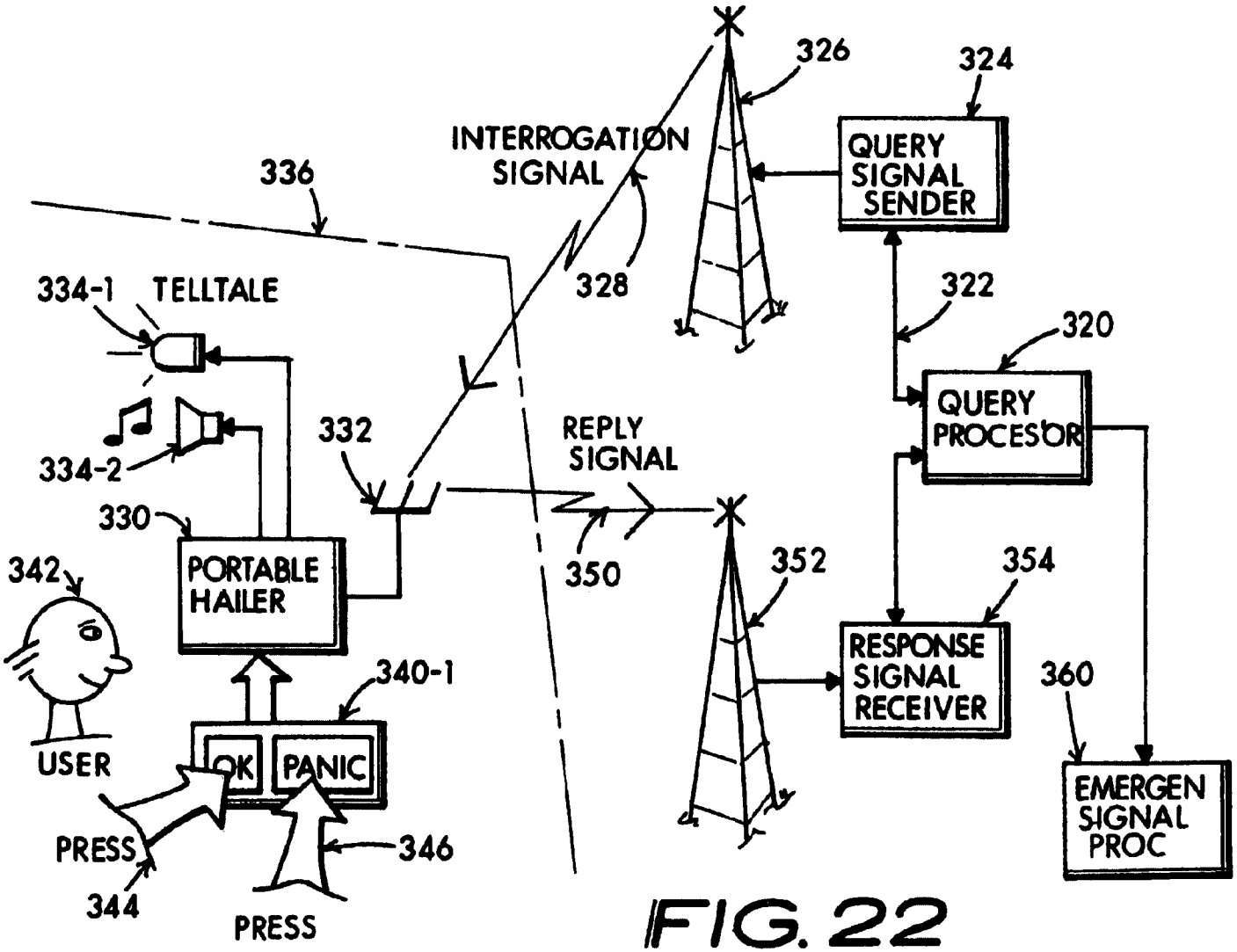
FIG. 22—Portable hailer paged from remote facility via wireless transmission.

With FIG. 22 the invention depicts a wireless system to include a (query) interrogation processor 320 which delivers a time appropriate signal on line 322 to an (query) interrogation signal sender 324 which couples with a wireless antenna 326. An encoded wireless interrogation (query) signal 328 results which couples to a remote hailer's antenna 332. The wireless signal 328 serves to set the portable hailer 330 into action, usually resulting in the delivery of a telltale light blink 334-1 or an audible beep 334-2 as a sensory cue to the user 342.

The user having been cued is expected to quickly respond to the cuing by pressing 344 the "OK" button 340-1 which acknowledges the user's response and probability for being okay. As hereinbefore explained, the timeliness of the response gives indication of the user's likely condition. A "PANIC" button is also shown which may be pressed 346 to quickly send an emergency signal. The acknowledgments or entries via the pushbuttons 340-1 route through the portable hailer to be sent via a wireless signal 350 between the hailer's antenna 332 and a receiving antenna 352 and response signal receiver 354. The interrogation signal continues to be routed to the query processor 320 where an emergency state finding is derived, essentially as "TRUE" or "FALSE" which couples with the emergency signal processor 360, usually for purpose of signaling a care-provider. It is obvious engineering practice to adapt this invention's teaching to a cellular telephone system, or similar wireless systems.

Figure 23:
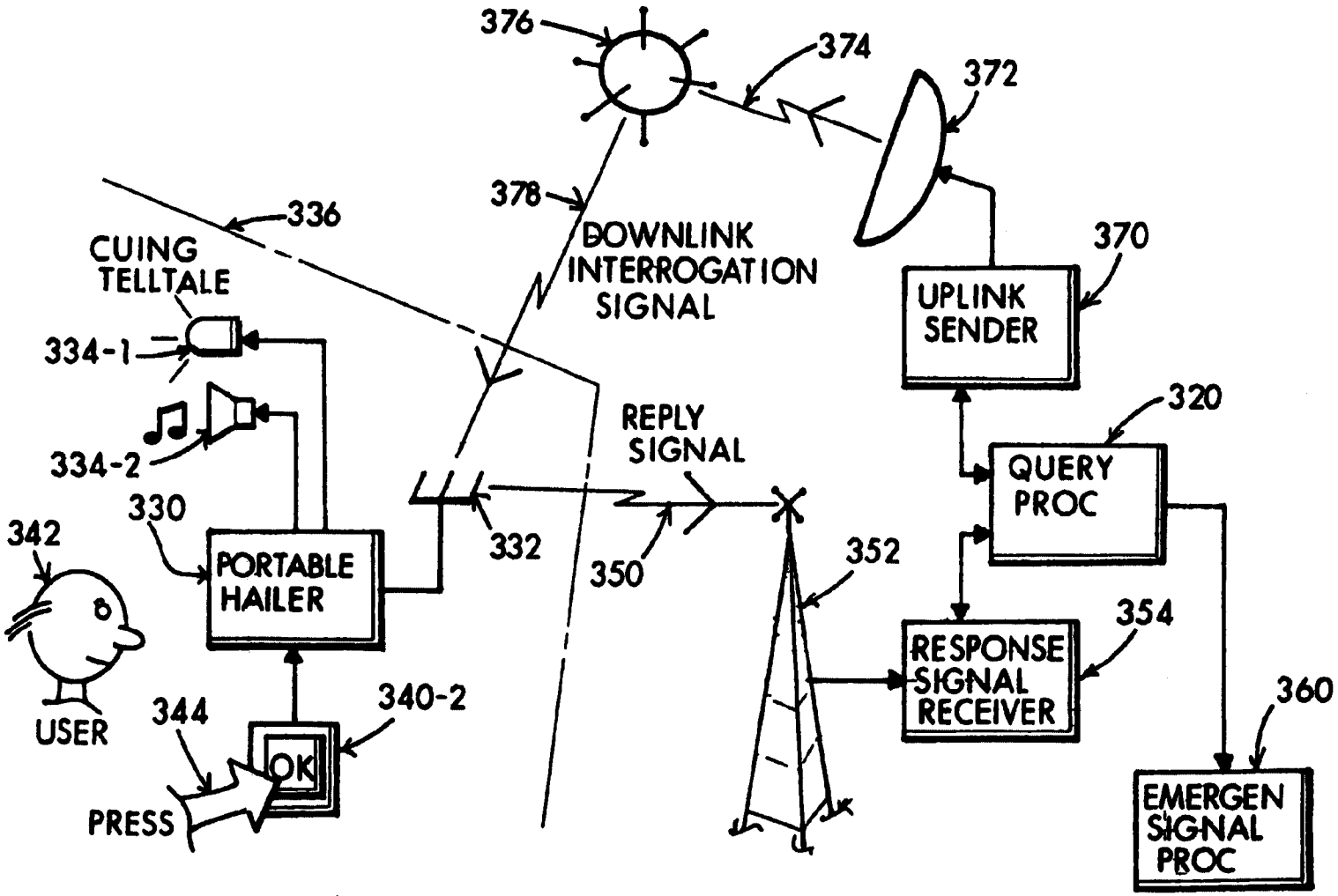
FIG. 23—Portable hailer paged from remote facility via satellite link.

Looking at FIG. 23 which is a variation of the methodology of FIG. 22, the query processor feeds an uplink sender 370 an interrogation control signal to produce a wireless signal coupled with an antenna 372. The wireless uplink signal 374 reports to a satellite transponder 376, rerouting the interrogation command as a downlink signal 378 that subsequently is received by the portable hailer's antenna 332. The hailer's functions are similar to the aforesaid FIG. 22. The acknowledgment switch 340-2 is shown as a singular entry function in this variation. The acknowledgment results in a wireless reply signal 350 reporting back to an antenna 352 for further amplification, processing and decision making to result in an emergency signal, or not.

One of principal objectives of the teachings of FIG. 22 and FIG. 23 is that a goodly number of at-risk users may be serviced via the interrogation signal 328 or down link signal 378 over a wide area. In such an arrangement, each user is assigned a uniquely encoded signal format which isolates each user's individualized response from any other user's possibly near-concurrent response.

Figure 24:
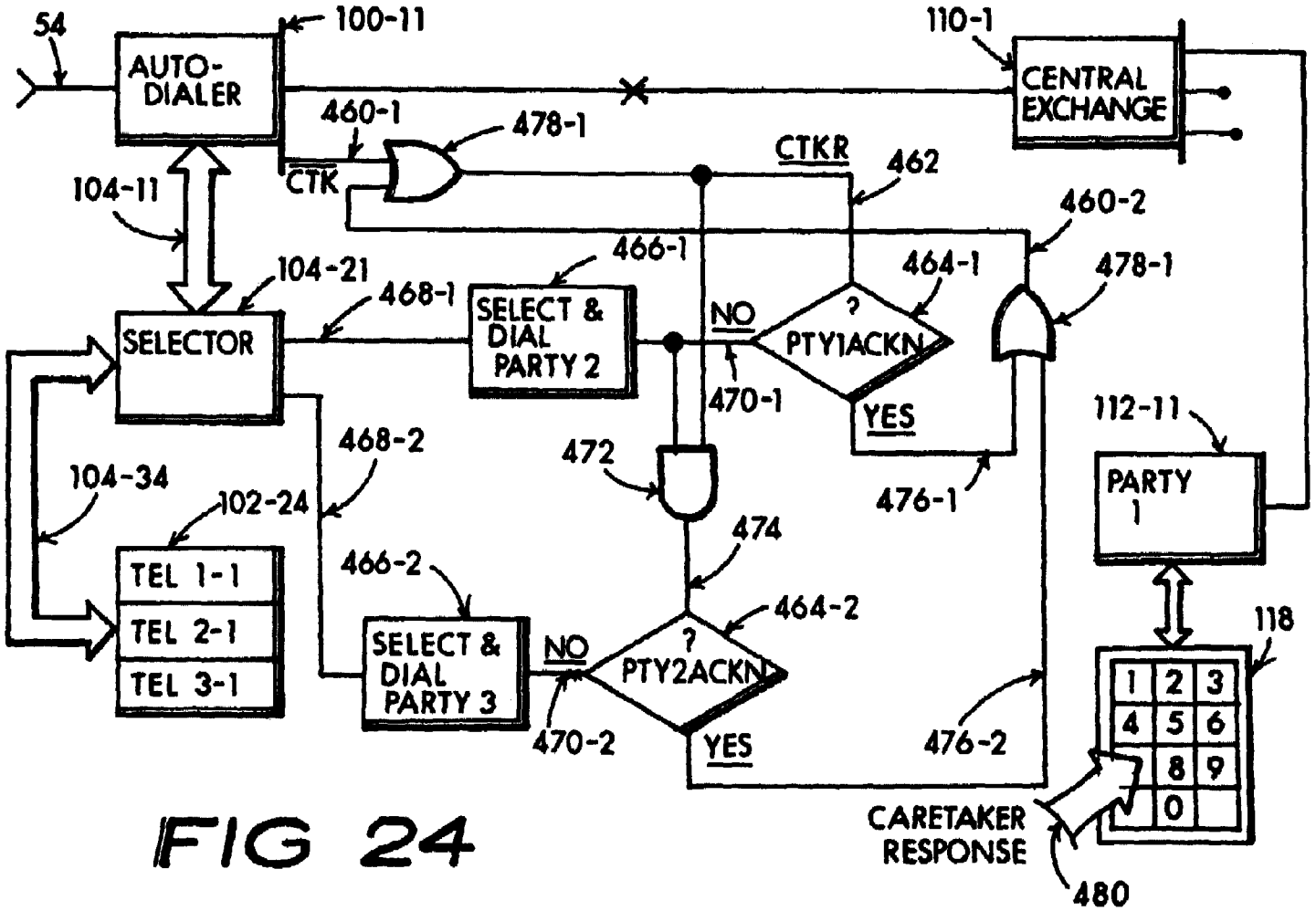
FIG. 24—Care-provider acknowledgment provision.

When a care-provider is autodialed, as discussed relative with FIG. 3, it is possible that the called party will not be available, e.g., "does not answer". To overcome this weak link in protecting the at-risk user, I intend that the called care-provider must enter a response upon picking-up their telephone. The response may be recognized merely as the act of picking-up, or in my preferred arrangement the called party responds by pressing a keybutton. In FIG. 24 I show an extension of the earlier FIG. 3 to include an autodialer 100-11 which responds to an emergency signal received on line 54. The autodialer in conjunction with a selector 104-21 initially picks the TEL 1-1 memory 102-24 page holding the first care-provider's telephone number (and related information if appropriate). The autodialer 100-11 dials and "calls" the central exchange 110-1 via public telephone lines 106-2. The central exchange directs the call to a telephone 112-11 associated with the care-provider's PARTY1. The telephone includes a keypad 118 which, enables a using care-provider to enter 480 an acknowledgment. This might be accomplished by pressing the "number 7" at the appropriate moment. As a result, the response is processed in the autodialer and results in a binary state signal on an outport line 460-1 coupled with one input of an OR gate 478-1. The acknowledgment by the called care-provider results in a HIGH state on line 460-1 pulling line 462 HIGH as coupled with the decision input of a logic decisor 464-1. A decoded HIGH state CTKR applied to the input of the decisor 464-1 includes data representing the care-provider 1 response. Recognition of the party 1 acknowledge PTY1ACKN response entry (in this case a Touchtone™ keybutton 7 entry) develops a HIGH state on the YES output line 476-1 as applied to an input of an OR gate 478-1. The OR gate output line 460-2 becomes set HIGH as applied to a second input of the OR gate 478-1. This state locks-up the remaining logic and permits that care-provider 1 (party 1) is the sole recipient of the instant emergency call.

In event the called party 112-11 does NOT enter a keybutton response, the non-response is advanced through the OR gate 478-1 and submitted to the decisor 464-1 and an input of an AND gate 472. The failure of the care-provider 1 giving timely response 480 develops a HIGH state on the NO line 470-1 as coupled with a dial care-provider 2 function 466-1 and an input of an AND gate 472. The result is a signal developed on line 468-1 establishes the selector 104-21 to introduce the TEL 2-1 telephone number for the second care-provider. Autodialing results in a call directed via the central exchange 110-1 to a party 2 care-provider 112-2 (see FIG. 3). As with the party 1, party 2 telephone 112-2 may include a keypad like 118 which enables the recipient of the call to properly respond by pressing a preselected keybutton, such the numeral 5. The response signal CTKR couples via line 462 with a remaining input of the AND gage 472, thence via line 474 to a second decisor 464-2. If the second-called care-provider acknowledges properly, the decisor 464-2 delivers a HIGH state on the YES output line 476-2 as applied to another input of the OR gate 478-1. The HIGH state locks-up further signal flow via the OR gate 478-1 and the called Party 2 assumes the role of care-provider.

Finding a failure of the called party 2 from returning an acknowledgment response gives rise to a HIGH state on the NO output line 470-2 delivered from a PTY2ACKH (party 2 acknowledge) decisor 464-2. This in turn enables the select & dial party 3 function 466-2 to deliver a HIGH state on line 468-2 to the selector 104-21. The selector picks the TEL 3-1 number to be called as the "third care-provider" and subsequential automatic calling of the third party ensues. It shall be obvious that further extension of this novel backup provision may include a larger plurality of care-providers, any one of whom may be utilized to check on a possible emergency condition.

Reasonable and comprehensive effort has been made to explain this invention in a manner which may enable a person of ordinary skill in the art to duplicate my findings. The utter essence of my invention is to provide a user with an emergency hailing device which reduces a likelihood for a user suffering an accident or chronic medical problem unattended. I fully expect that a skilled artisan may develop alternate details for my invention's implementation including a considerable variation regarding physical form, cuing technique, response button access, electrical hookup, hardware detail, monitoring techniques, encoding methods, software configuration and obvious operational preferences. I say that these obvious variants occur as a natural outspread from the invention's central novelty. They naturally result from mere applied engineering skill coupled with an ever-increasing plethora of options regarding parts, components, techniques and programming skills which may be utilized to duplicate my invention's contribution to the art-field.

For example, this invention allows that the cuing and the response timing functions may be integrated individually or collectively in either the wearable appurtenance device or in the base station apparatus. As a result, cuing may originate local with the user or distally, from the base station or accessory (satellite) telltales coupled with the base station. A central aspect of this invention provides that the "response" to a cue is actuatable in an immediate proximity with the user and most commonly as a wearable "button" which may be pressed. However, this again shall not be construed a limitation because a response may be obtained with equivalent efficacity when the respons actuator is a "button" on the base-station, a "button on the wall", or when the response is obtained by voice-recognition of a timely answer by the user. Hence, the artisan shall realize that it is not the specific "how to fabricate" aspect of this invention which is solely expressed in it's novelty, but rather the underlying essence of the invention is that of cuing, with an expected response from the cued party which if not present in a timely manner, serves to hail a care-provider or other appropriate party.

Any attempt by another to circumvent the essence of my invention to deliver an emergency signal to a care-provider in event of a hailed and cued at-risk user's failure to promptly acknowledge the cue shall be prudently viewed with caution and suspicion. I realize that hindsight may make other physical and technical embodiments exhibiting a difference in operational or functional detail from that which I specifically depict readily apparent to and subsequently tried by others. As a consequence to this realization, all technical hookup, signal processing and physical embodiment variations irrespective of their extent, shall be found as merely obvious modifications of or extensions to my invention's fundamental teachings and therefore to be irrefutably within the scope of my invention as herewithin taught and presently claimed. Exceptional engineering configurations of the hardware associated with this invention, intended for the "special needs" of a particular class or group of users shall remain within the scope of this inventions claims and merely an obvious variation on the invention's fundamental essence.

I claim for my invention:

1. An emergency hailing method for interrogating fitness of an at-risk user, comprising steps of:

equipping the at-risk user with a portable emergency hailer system including a base station and a preferably wearable hailing device;

sequencing the hailer system to establish an abeyant mode first time interval and an active mode second time interval;

sensibly cuing the at-risk user upon the onset of the active mode to respond by promptly submitting a manual acknowledgment;

determining a timely submission of the manual acknowledgment during the second time interval as indicative of acceptable at-risk user's fitness and thereupon return the emergency hailer system to the abeyant mode;

ascertaining a response time delay which occurs between the sensible cuing of the at-risk user and the timely submission of the manual acknowledgment of the cuing event;

reducing duration of the first time interval relative with an increase in the response time delay;

increasing the duration of the first time interval relative with a decrease in the response time delay;

whereby an increase in the response time delay results in a more frequently recurring fitness interrogation and conversely a decrease in the response time delay results in a less frequently recurring fitness interrogation; and, resolving a failure to submit the manual acknowledgment during the active mode time interval as indicative of the at-risk user's fitness being presently unknown and consequentially effectuate an emergency signal state.

2. The emergency hailer method of claim 1 comprising further steps of:

adjusting duration of the active mode second time interval relative with the ascertained response time delay, including:

reducing duration of the second time interval relative with a decrease in the response time delay;

increasing the duration of the second time interval relative with an increase in the response time delay;

whereby an increase in the response time delay results in extending duration of the active mode second time interval and conversely a decrease in the response time delay results in a shortening of the active mode second time interval, thereby automatically adjusting the second time interval to tolerate variation in the at-risk user's quickness of response.

3. The emergency hailer method of claim 1 comprising further steps of:

adjusting duration of the active mode second time interval relative with the ascertained response time delay, including:

reducing duration of the second time interval proportional to an increase in the response time delay;

increasing the duration of the second time interval proportional to a decrease in the response time delay;

whereby a decrease in the response time delay results in extending duration of the active mode second time interval and conversely an increase in the response time delay results in a shortening of the active mode second time interval, thereby automatically adjusting the second time interval to tolerate variation in the at-risk user's quickness of response.

4. The emergency hailer method of claim 1 comprising a further step of:

serving a plurality of the at-risk users to include a first client user and at least a second client user;

first configuring a first wearable hailing device including the provision for submitting the manual acknowledgment, and optionally, to be physically worn as a first vigilant appurtenance by the first client user;

first initiating a first encoded alert signal in response to a lacking or behindhand submission of the manual acknowledgment of the first cue by the first client user;

first sending the first encoded alert signal to a local base station sited in association with the plurality of at-risk users;

a second cuing of a second client user to promptly submit the manual acknowledgment of the second cuing event;

second configuring a second wearable hailing device including the provision for submitting the manual acknowledgment, and optionally, to be physically worn as a second vigilant appurtenance by the second client user;

second initiating a second encoded alert signal in response to the lacking or the behindhand occurrence of the manual acknowledgment of the second cue by the second client user;

second transmitting the second encoded alert signal to the local base station sited in association with the plurality of at-risk users; and, configuring the local base station to receive at least one of the first encoded alert signal and the second encoded alert signal and respond by at least one of producing an alarm signal and sending a first emergency signal, whereby, the alert signal encoding enables a single local base station to be uniquely responsive to each one of a plurality of at-risk users ordinarily sharing an inhabitancy.

5. The emergency hailer method of claim 1 comprising further steps of:

sending a periodically recurrent wireless check signal from the wearable hailing device to the local base station;

determining an absence of reception of the wireless check signal by the local base station for a period of time exceeding a predetermined limit and producing an interruption state signal;

optionally configuring the local base station to emanate at least one of activating a local telltale signal and produce a fault-indicative emergency signal state in response to the interruption state signal.

6. The emergency hailer method of claim 1 comprising further steps of:

configuring the local base station to respond to the emergency state signal and automatically dial at least one care-provider's emergency telephone number; and, sending a predetermined emergency message signal to the care-provider who may answer the emergency telephone number.

7. The emergency hailer method of claim 1 comprising further steps of:

configuring the local base station to respond to the emergency state signal and automatically dial at least one care-provider's emergency telephone number;

sending a predetermined emergency message signal to the care-provider who may answer the emergency telephone number;

confirming receipt of the predetermined emergency message signal by at least one of a first dialed primary care-provider and a subsequently dialed first backup care-provider;

urging the primary care-provider who may answer the dialed emergency telephone number to acknowledge receipt by returning a responsion signal ordinarily initiated by pressing a predetermined dial keypad button; and, alternatively dialing a backup care-provider's emergency telephone number in absence of a timely return of the responsion signal by a previously dialed primary care-provider.

8. The emergency hailer method of claim 1 comprising further steps of:

reversing of consequential relationship between the ascertained response time delay and the first time interval, including:

reducing duration of the first time interval relative with a decrease in the response time delay;

increasing the duration of the first time interval relative with an increase in the response time delay;

whereby a decrease in the response time delay results in a more frequently recurring fitness interrogation and conversely an increase in the response time delay results in a less frequently recurring fitness interrogation.

9. An emergency hailing method for confirming a probable state of well-being of an at-risk user, comprising steps of:

equipping the at-risk user with a wireless interrogative system comprising a base station and a portable hailing device;

sequencing the interrogative system with an ordered pattern of abeyant modes and active modes;

maintaining the abeyant mode for a first timed interval;

setting the personal transponder to the active mode upon time-out of a first timed interval;

sensibly cuing the at-risk user and initiating a second timing interval upon onset of the active mode;

urging the at-risk user to manually acknowledge the sensible cue by actuating a responsion switch preferably included in the portable hailing device;

resetting the abeyant mode and the first timing interval in response to the manual acknowledgment being timely occurrent during the second timed interval;

measuring duration of a response time lapse between onset of the active mode and the manual acknowledgment;

changing the first timing interval relative with a change in the measured duration of the response time lapse; and, evoking an emergency state signal upon finding a lacking of manual acknowledgment during the second timing interval.

10. The emergency hailing method of claim 9 comprising a further steps of changing the second timing interval relative with finding a change in the measured duration of the response time lapse.

11. The emergency hailing method of claim 9 wherein the changing of the first timing interval further includes the steps of:

decreasing the first timing interval relative with an increase in the measured duration of the response time lapse; and, conversely increasing the first timing interval relative with a decrease in the measured duration of the response time lapse.

12. The emergency hailing method of claim 11 comprising further steps of:

sending a wireless ranging signal between the base station and the portable hailing device;

receiving the wireless ranging signal while the base station and the portable hailing device are within working range of one-another;

determining a loss of the wireless ranging signal reception and therefrom establishing the mutual out-of-range state.

13. The emergency hailing method of claim 9 wherein the base station comprises:

periodically sending an interrogation signal to the portable hailing device upon time-out of the first timing interval;

cuing the at-risk user to manually actuate the responsion switch and promptly send a reply signal to the base station preferably prior to elapse of the second timing interval;

processing timeliness of the reply signal returned to the base station;

first finding the reply signal to be timely returned during the second timing interval and reinitiating the abeyant mode and the first timing interval;

second finding the reply signal to remain silent during the second timing interval and to subsequently said evoke the emergency state signal promptly upon time-out of the second timing interval.

14. The emergency hailing method of claim 9 comprising a further step of inhibiting the evocation of the emergency state signal and preferably alerting the at-risk user whenever the base station and portable hailing device are mutually out-of-range of one-another.

15. The emergency hailing method of claim 9 comprising further steps of:

auto-dialing a first care-provider's emergency telephone number in an immediate response to the emergency state signal;

signaling the evocation of the emergency state signal to the first care-provider.

16. The emergency hailing method of claim 9 comprising further steps of:

auto-dialing a first care-provider's emergency telephone number in an immediate response to the emergency state signal;

signaling the evocation of the emergency state signal to the first care-provider, urging the first care-provider to acknowledge notification by manually submitting a responsion signal by promptly pressing at least one predesignated Touch-tone™ keypad button; and otherwise, finding the responsion signal lacking and subsequently auto-dialing an alternate care-provider's emergency telephone number.

17. An emergency hailing apparatus including a portable base station and preferably portable hailing device immediately associated with an at-risk user, comprising:

abeyant mode control means operative for a first time interval;

active mode control means enabled upon timeout of the first timed abeyant mode and maintained operative for a second time interval;

manual response means integrated into the portable hailing device;

sensible cuing means enabled by an onset of the active mode for prompting the at-risk user to timely actuate the manual response means during the second time interval;

system control means for resetting the abeyant mode control means upon finding the timely actuation of the manual response means and to evoke an emergency state signal upon the finding of a lacking of the timely actuation;

assessment means for measuring response time lapse between the onset of the active mode and the timely actuation of the manual response means;

adjustor means for changing duration of the first time interval relative with the measured response time lapse;

whereby, a failure by the at-risk user to promptly respond to a sensible cue may be interpreted as a probable cause for concern regarding the at-risk user's medical or physical well-being and as a sufficient reason for the evocation of the emergency state signal.

18. The emergency hailing apparatus of claim 17 further comprising:

a range determination means comprising at least one of:

a first sending means for submitting a periodically recurrent wireless ranging signal originating from the base station and received by the portable hailing device;

a second sending means for translating a periodically recurrent wireless ranging signal originating from the portable hailing device and received by the base station;

a range verification means operating in conjunction with the range determination means to maintain the emergency hailing apparatus in the abeyant mode when the reception of the wireless ranging signal fails to occur.

19. The emergency hailing apparatus of claim 17 further comprising:

the adjustor means functions to decrease the first time interval in response to an increase in the measured response time and conversely to increase the first time interval in response to a decrease in the measured response time;

whereby a slow-down by the at-risk user in manually responding to the sensible cue produces an increase in frequency of interrogation and otherwise a quicker response may produce a less frequent interrogation.

20. The portable emergency hailing apparatus of claim 17 further comprising:

auto-dialing means responsive to the emergency state signal and configured to automatically dial at least one predetermined care-provider's telephone number; and, messaging means effective to impart an emergency message to a care-provider answering the automatically dialed said telephone number;

wherein the messaging means and auto-dialing means may further include:

riposte determinator means recognizing a reciprocative key signal submitted by the answering care-provider in response to a protocol instruction; and otherwise, reenabling the auto-dialing means to effectively dial another care-provider's telephone number when the presently called care-provider does not enter the distinctive key signal in accord with the protocol instructions;

whereby, failure to enter the distinctive key signal indicates that the called party is not available and an alternate party is called.

* * * * *